US008915611B2

(12) United States Patent
Zhang

(10) Patent No.: US 8,915,611 B2
(45) Date of Patent: Dec. 23, 2014

(54) LIGHT WELL PROVIDING WIDE ANGLE UP LIGHTING IN AN LED LUMINAIRE

(75) Inventor: John X. Zhang, Walnut Creek, CA (US)

(73) Assignee: Lunera Lighting, Inc., Redwood City, CA (US)

( * ) Notice: Subject to any disclaimer, the term of this patent is extended or adjusted under 35 U.S.C. 154(b) by 480 days.

(21) Appl. No.: 13/117,649

(22) Filed: May 27, 2011

(65) Prior Publication Data

US 2012/0257383 A1 Oct. 11, 2012

Related U.S. Application Data

(60) Provisional application No. 61/473,720, filed on Apr. 8, 2011.

(51) Int. Cl.

| | |
|---|---|
| ***F21V 7/04*** | (2006.01) |
| ***F21V 17/10*** | (2006.01) |
| ***F21V 13/04*** | (2006.01) |
| ***F21V 15/015*** | (2006.01) |
| ***F21S 2/00*** | (2006.01) |
| *F21Y 101/02* | (2006.01) |
| *F21Y 103/00* | (2006.01) |
| *F21V 7/00* | (2006.01) |
| *F21S 8/06* | (2006.01) |
| *F21V 5/02* | (2006.01) |

(52) U.S. Cl.

CPC ..... *F21S 2/005* (2013.01); *F21Y 2101/02* (2013.01); *F21V 17/104* (2013.01); *F21Y 2103/003* (2013.01); *F21V 7/0016* (2013.01); *F21V 13/04* (2013.01); *F21S 8/061* (2013.01); *F21V 15/015* (2013.01); *F21V 5/02* (2013.01)

USPC ..... 362/241; 362/247; 362/307; 362/404

(58) Field of Classification Search

CPC ..... F21V 13/00; F21V 13/02; F21V 7/04; F21V 7/10; F21V 7/0091; F21V 7/0008; F21V 7/0016; F21V 7/0025; F21V 7/033; F21V 21/02; F21V 21/025; F21S 8/00; F21S 8/03; F21S 8/033; F21S 8/036; F21S 8/043; F21S 8/06; F21K 9/00; F21K 9/30

USPC ..... 362/145, 147, 237, 240, 241–243, 247, 362/249.01, 249.02, 249.06, 297, 300, 301, 362/307, 346, 404

See application file for complete search history.

(56) References Cited

U.S. PATENT DOCUMENTS 7,530,712 B2 * 5/2009 Lin et al. ..... 362/247

(Continued)

FOREIGN PATENT DOCUMENTS

| | | | |
|---|---|---|---|
| GB | 2405461 | A | 3/2005 |
| GB | 2454254 | A | 5/2009 |
| WO | WO2011/021719 | A1 | 2/2011 |

OTHER PUBLICATIONS

International Search Report mailed Jul. 9, 2012, in corresponding International PCT Application No. PCT/US2012/032437, filed Apr. 5, 2012.

(Continued)

*Primary Examiner* — Thomas M Sember

(74) *Attorney, Agent, or Firm* — North Weber & Baugh LLP

(57) ABSTRACT

A luminaire providing wide angle up lighting using light wells is provided. The luminaire can include a frame having a center plate and side walls. LED modules can be disposed adjacent to opposite side walls such that the LED modules are oriented towards each other. The luminaire can include light wells positioned over each of the LED modules such that light emitted by the LED modules may be reflected within the light wells until it is transmitted by a lens region of the light well at a wide angle relative to the nadir of the luminaire. The light wells can include reflective layers disposed on all surfaces surrounding the LED modules, and a transmittance lens region through which light, emitted by the LED modules as point sources, can exit the fixture as a surface of light. Light emitted by LED modules and light wells disposed on opposite sides of the luminaire can provide a bat wing distribution of up light.

18 Claims, 23 Drawing Sheets

(56) References Cited

U.S. PATENT DOCUMENTS

| | | | | |
|---|---|---|---|---|
| 8,348,459 | B2 * | 1/2013 | Jacobi | 362/241 |
| 2010/0321919 | A1 * | 12/2010 | Yang | 362/84 |
| 2011/0096544 | A1 * | 4/2011 | Nakamura | 362/235 |

OTHER PUBLICATIONS

Written Opinion mailed Jul. 9, 2012, in corresponding International PCT Application No. PCT/US2012/032437, filed Apr. 5, 2012.

International Preliminary Report on Patentability issued Oct. 8, 2013, in corresponding International PCT Application No. PCT/US2012/032437, filed Apr. 5, 2012.

* cited by examiner

920

| Zone Angles (922) | lumens (924) | % Lumens (926) |
|---|---|---|
| 90-100 | 78 | 11.39% |
| 100-110 | 135 | 19.71% |
| 110-120 | 125 | 18.25% |
| 120-130 | 112 | 16.35% |
| 130-140 | 89 | 12.99% |
| 140-150 | 67 | 9.78% |
| 150-160 | 44 | 6.42% |
| 160-170 | 26 | 3.80% |
| 170-180 | 9 | 1.31% |
| 90-180 | 685.0 | 100.00% |

LIGHT WELL PROVIDING WIDE ANGLE UP LIGHTING IN AN LED LUMINAIRE

CROSS-REFERENCE OF RELATED APPLICATION

This application claims the benefit of previously filed U.S. Provisional Patent Application No. 61/473,720, entitled "LUMINAIRE PROVIDING WIDE ANGLE UP LIGHTING," filed Apr. 8, 2011, which is incorporated herein in its entirety.

BACKGROUND

Light fixtures provide a source of light to illuminate dark environments. A light fixture, or luminaire, can be constructed from a light source placed in contact with a cover directing light from the light source into an environment. In some cases, the luminaire can be dropped from a ceiling to provide down light onto a working surface. Because the luminaire is dropped relative to the ceiling, however, the light emitted by the luminaire may not reach regions of the ceiling immediately above the luminaire. This may create a "cave" effect of a dark region on the ceiling above the luminaire, which may be displeasing to users.

SUMMARY

A LED luminaire having a light well providing up light at a wide angle is provided.

A LED luminaire can include an elongated planar frame for supporting at least one LED module or other light source, and optical components for controlling the manner in which light emitted by the light source is transmitted. The frame can include one or more light sources and optical components for providing down light towards a working plane. The frame can also include one or more light sources and optical components for providing up light towards a ceiling or structure to which the frame is attached. For example, the frame can include two rows of LED modules positioned along elongated edges of the upper surface of the frame, where each row of LED modules is oriented towards the other row (e.g., the LED modules emit light substantially parallel to the elongated planar frame).

To minimize the number of luminaires required to illuminate a particular space, a LED luminaire can include one or more light wells positioned over LED modules used for up lighting. The light wells can be designed to direct light provided from LED modules to wide angles relative to the luminaire. For example, the light wells can generate a radiation pattern that includes long lobes angled at approximately 105 degrees from a nadir of the luminaire.

Each light well can include a lens having a reflectance region and a transmittance region. The lens can be secured to the frame such that the LED modules are enclosed in a volume defined on some sides by portions of the frame, and on other sides by the lens. In some cases, the transmittance region can extend substantially perpendicular from the reflectance region such that the reflectance region is substantially parallel to a plane of the frame, and the transmittance region is substantially parallel to a side wall extending from the plane of the frame, where the side wall retains the LED modules. In some cases, however, at least a portion of the reflectance region can be partially transmissive to improve the light pattern provided by the light well. For example, the reflectance region can have a transmittance in the range of 1% to 5%.

To improve performance of the light well, a reflective and diffuse layer can be applied to some or all surfaces of the frame and of the reflective region that are within the volume enclosed by the light well. For example, portions of the frame other than those retaining the LED modules can be covered by a white layer. As another example, the reflective portion of the lens can be covered by a white layer, or partially covered to allow for a 1 to 5% transmittance. Some or all portions of the reflective layer may have at least 92% reflectance so that most light emitted by the LED modules is transmitted through the transmittance region of the lens.

To further improve the performance of the LED luminaire, a reflective layer can be provided over a top surface of the frame between the light wells of the opposing LED modules. For example, a single white layer can be positioned over the frame such that the white layer is partially within each light well, as well as extending between the light wells.

BRIEF DESCRIPTION OF THE DRAWINGS

The above and other features of the present invention, its nature and various advantages will be more apparent upon consideration of the following detailed description, taken in conjunction with the accompanying drawings in which.

DETAILED DESCRIPTION

This is directed to a LED luminaire having a light well for providing up light in a wide angle distribution.

Figure 1:
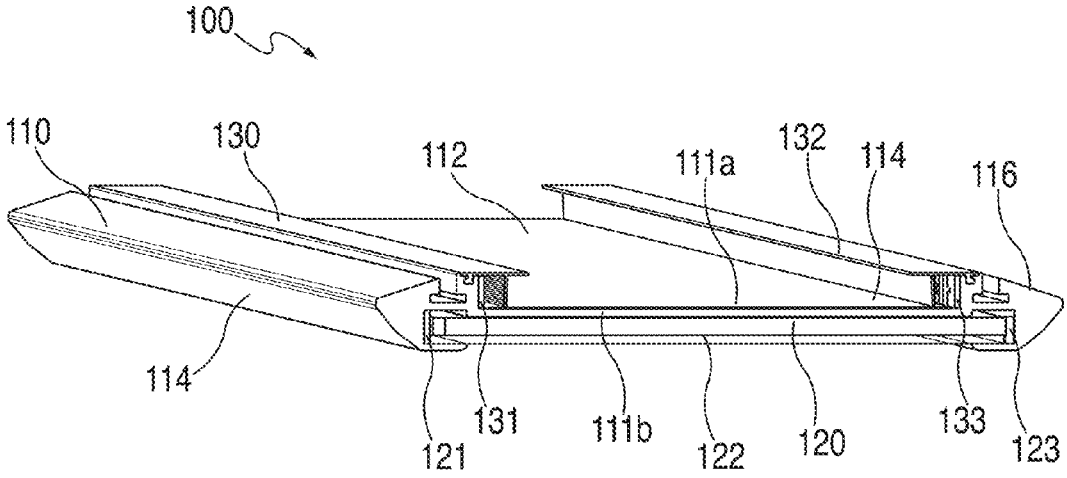
FIG. 1 is a perspective view of an illustrative LED luminaire in accordance with some embodiments of the invention.

A LED luminaire can be used to illuminate an environment. FIG. 1 is a perspective view of an illustrative LED luminaire in accordance with some embodiments of the invention. Luminaire 100 can include frame 110 providing a structure for the luminaire. Frame 110 can include center plate 112 bordered by parallel walls 114 and 116. Center plate 112 can include a substantially planar elongated component. Center plate 112 can have any suitable dimensions including, for example, a width of less than 12", and a length of 4', 8', or another length larger than the width. Center plate 112 may be orientated such that a plane of center plate 112 is substantially parallel or co-planar with a ceiling or floor of an environment in which luminaire 100 is placed. Walls 114 and 116 can include features for receiving one or more light modules (e.g., LED modules or LED packages) or optical components of the luminaire.

In some cases, luminaire 100 can include LED light module 121 secured to wall 114, and LED light module 123 secured to wall 116. Light modules 121 and 123 can be positioned adjacent to lower surface 111*b* of center plate 112, such that light emitted by the modules can be transmitted down from luminaire 100 towards a work plane. Luminaire 100 can include light guide 120 and diffuser 122 for defining or tuning the manner in which light is emitted from the luminaire. In some cases, luminaire 100 can include other optical components instead of or in addition to light guide 120 and diffuser 122. For example, luminaire 100 can include a reflective layer positioned between light guide 120 and center plate 112 to direct more light out of luminaire 100 and increase the efficiency of the luminaire.

In addition to light modules for providing down light, luminaire 100 can include light module 131 placed adjacent to wall 114, and light module 133 placed adjacent to wall 116, where light modules 131 and 133 are both adjacent to upper surface 111*a* of center plate 112. In this manner, light modules 131 and 133 can serve to provide up light illuminating a region above luminaire 100. Luminaire 100 can include one or more optical components to adjust or modify the light emitted by light modules 131 and 133. In some cases, luminaire 100 can include a light well for providing wide angled illumination, as is described below in more detail. The light well can include lens 130 placed over light module 131 and lens 132 placed over light module 133. The light wells can be constructed to provide a wide angle radiation pattern that illuminates the regions of a ceiling immediately above luminaire 100, as well as regions above and to the side of luminaire 100. In some cases, luminaire 100 can in addition include reflective layer 114 placed between light modules 131 and 133 and lens 130 and 132, respectively, such that more light emitted by the light modules is reflected towards the lens.

Figure 2:
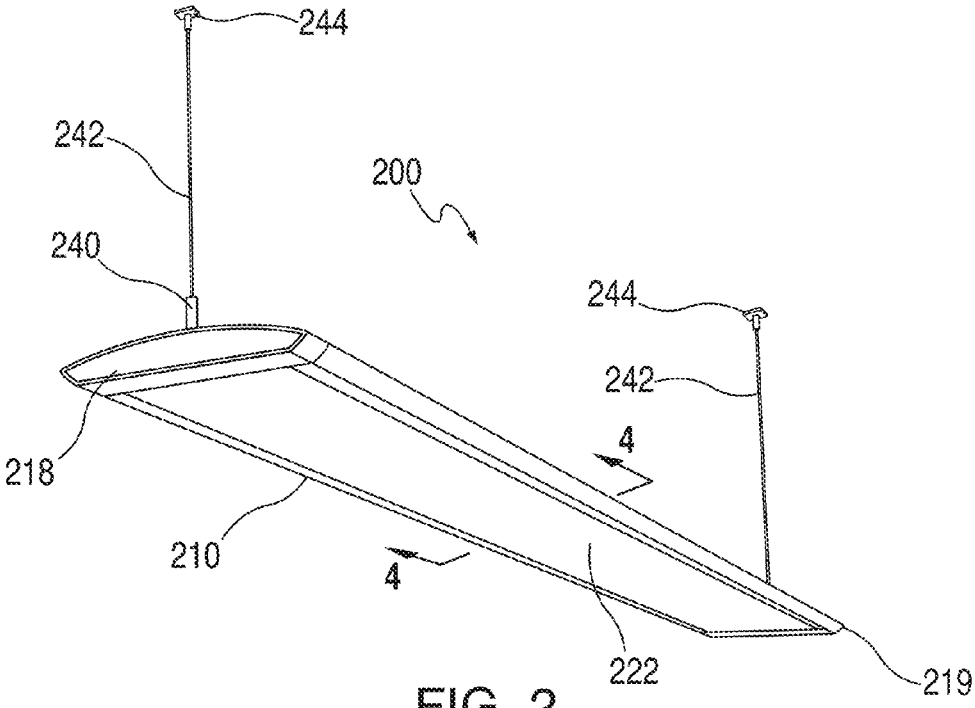
FIG. 2 is a perspective view of an illustrative LED luminaire mounted to a ceiling in accordance with embodiments of the invention.

The LED luminaire can be mounted to a ceiling, under a cabinet, or to any other suitable fixture using different approaches. FIG. 2 is a perspective view of an illustrative luminaire mounted to a ceiling in accordance with embodiments of the invention. Luminaire 200 can include some or all of the features of the luminaires described herein. Luminaire 200 can include frame 210 providing a structure for the luminaire, which can support or retain optical component 222 (e.g., a diffuser) used to transmit light into a room. To mount luminaire 200 to a ceiling, luminaire 200 can include mounting brackets 240 at each of ends 218 and 219 of the luminaire. Mounting brackets 240 can be secured to frame 210, for example using a mechanical connector (e.g., a bolt or screw), a tab, interlocking components, hook and fastener material, an adhesive, tape, or any other connecting mechanism. Mounting brackets 240 can be disposed at any suitable position along luminaire 200. In some cases, mounting brackets 240 can be positioned near opposite ends of frame 210 to evenly support the luminaire. The distance between mounting brackets 240 can be determined, for example, based on the size or shape of frame 210 (e.g., place a mounting bracket at each end of the frame), the strength of each mounting bracket, the stiffness of the frame, cosmetic considerations, or other such considerations. In one implementation, mounting brackets can be provided at 4 feet or 8 feet intervals.

Each mounting bracket 240 can be coupled to cable 242 extending from the mounting bracket towards the ceiling. Cable 242 can have any suitable diameter including, for example, a small diameter to be more discrete. Cable 242 can be constructed from any suitable material having adequate structural or mechanical properties. For example, cable 242 can be constructed from metal, plastic, or a composite material. In some cases, cable 242 can be used to provide power to luminaire 240, for example by serving as a conductor, or by including a separate conductor bundled with the cable. Cable 242 can have any suitable length including, for example, a length based on the height of the ceiling relative to the floor, or a desired distance between luminaire 200 and a working surface (e.g., a desk in an office environment). At an end of cable 242 opposite mounting bracket 240, luminaire 200 can include connector 244. Connector 244 can include any suitable feature for being mounted to a ceiling. For example, connector 244 can include arms or other features for coupling to a rail on a ceiling. As another example, connector 244 can include a fastener to engage the ceiling.

Different standards bodies define recommended practices for illumination by fixtures in different rooms. For example, the American National Standards Institute (ANSI) and the Illuminating Engineering Society of North America (IESNA) have defined a standard of at least 30 foot candles of average luminance onto a work plane by luminaires in a room, and a ceiling luminance ratio of at most 8:1. To minimize costs, therefore, it may be desirable to design luminaires that satisfy the ANSI/IESNA standards while reducing the number of luminaires required in a room to do so. It may therefore be desirable to design a luminaire providing a wide angle up light such that luminaires can be placed far apart while still adhering to the 8:1 ratio for ceiling luminance.

Figure 3:
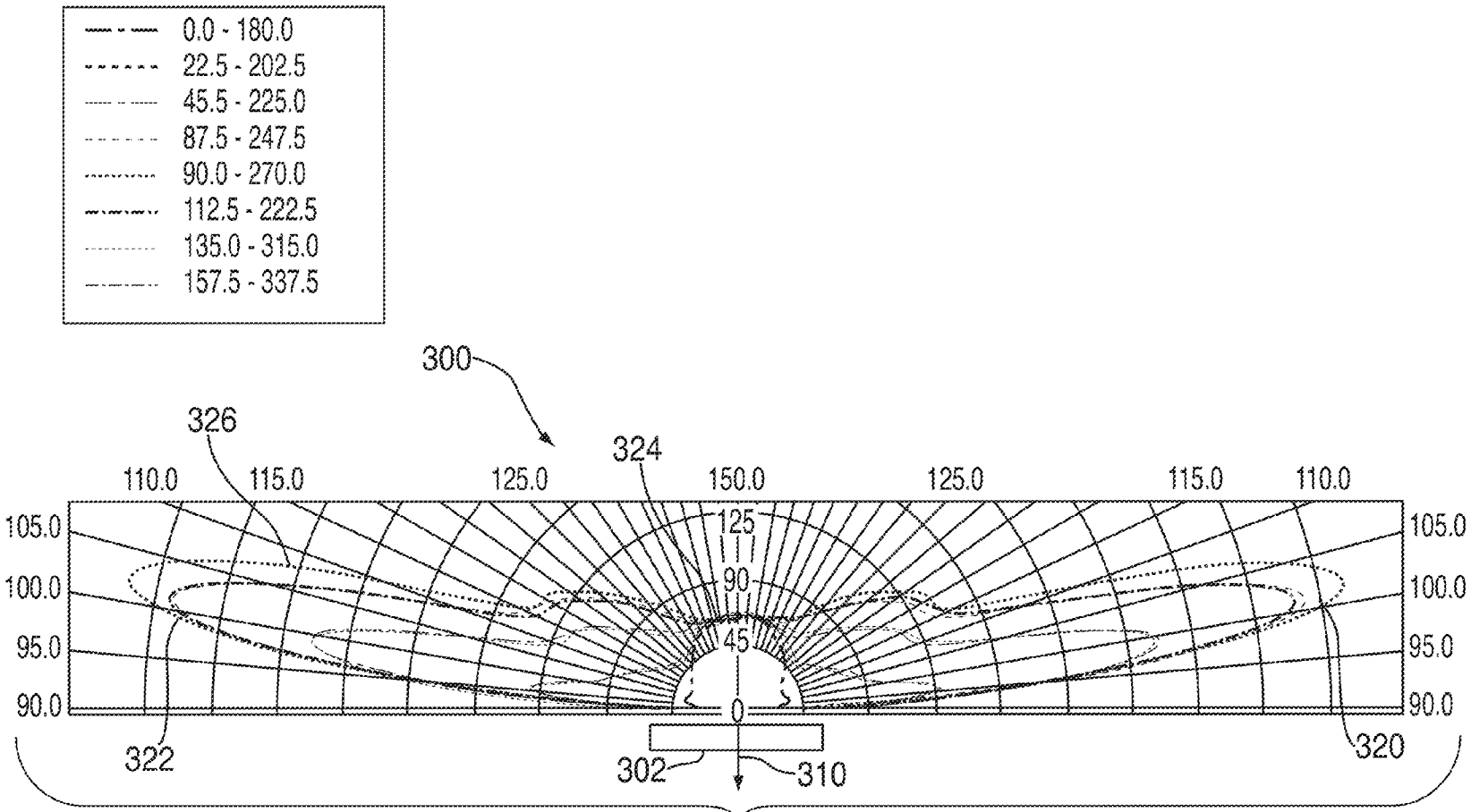
FIG. 3 shows an illustrative desired radiation distribution for up light of a luminaire in accordance with some embodiments of the invention.

FIG. 3 shows an illustrative desired radiation distribution for up light of a luminaire in accordance with some embodiments of the invention. Radiation pattern 300 can represent up light emitted by a luminaire oriented as shown by representation 302. Representation 300 can include several lobes at different angles relative to down axis 310. For example, representation 300 can include extended lobes 320 and 322 oriented at substantially 100 degrees (e.g., between 95 degrees and 105 degrees in both direction relative to axis 310). Each of lobes 320 and 322 can be large or extend relatively far, as lobes 320 and 322 from several luminaires placed next to each other can combine to provide a ceiling luminance ratio of 8:1 when the luminaires are spaced far apart.

To eliminate dark regions above the luminaire (e.g., to alleviate a cave effect), representation 300 can include center lobe 324 for illuminating portions of the ceiling above the luminaire. Lobe 324 may be smaller than lobes 320 and 322, as less light may be necessary immediately above the luminaire because of the proximity of the ceiling. In effect, representation 300 includes a relatively flat line 326 extending perpendicular to down axis 310. This indicates that the amount of light reaching the ceiling is relatively constant both near and away from the luminaire.

Figure 4:
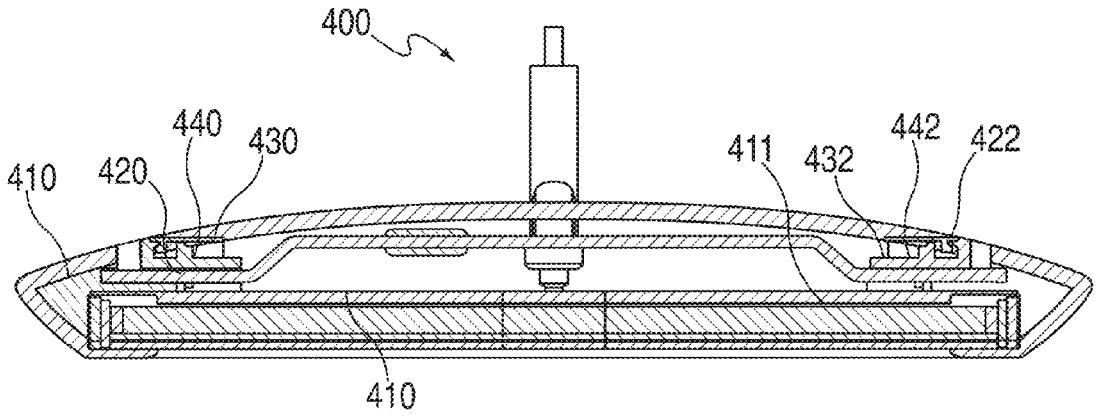
FIG. 4 is a sectional view of an illustrative LED luminaire in accordance with some embodiments of the invention.

To provide a radiation pattern such as that shown by representation 300, a LED luminaire can include several LED modules and optical components for providing up light. FIG. 4 is a sectional view of an illustrative LED luminaire in accordance with some embodiments of the invention. Luminaire 400 can include some or all of the features of luminaires described herein. Luminaire 400 can include frame 410 providing a structure for the luminaire. Frame 410 can include center plate 412 having a top surface 411 above which light can be emitted towards a ceiling (e.g., away from a work plane). Luminaire 400 can include first LED module 420 mounted to a first side of frame 410, and second LED module 422 mounted to a second side of frame 410. The LED modules can be positioned to emit light oriented substantially parallel to a plane of center plate 412 (e.g., perpendicular to a nadir of luminaire 400). In particular, first LED module 420 and second LED module 422 can be oriented towards each other in a cross-lighting configuration. The particular light emitted by each of LED modules 420 and 422, however, may be modified from a point source to larger planar source by light wells in which the LED modules are placed.

Luminaire 400 can include light well 440 having lens 430 positioned over LED module 420, and light well 442 having lens 432 positioned over LED module 422. The light wells can be designed to provide radiation patterns for each of the LED modules that combine to create desired radiation pattern 300 (FIG. 3).

Figure 5:
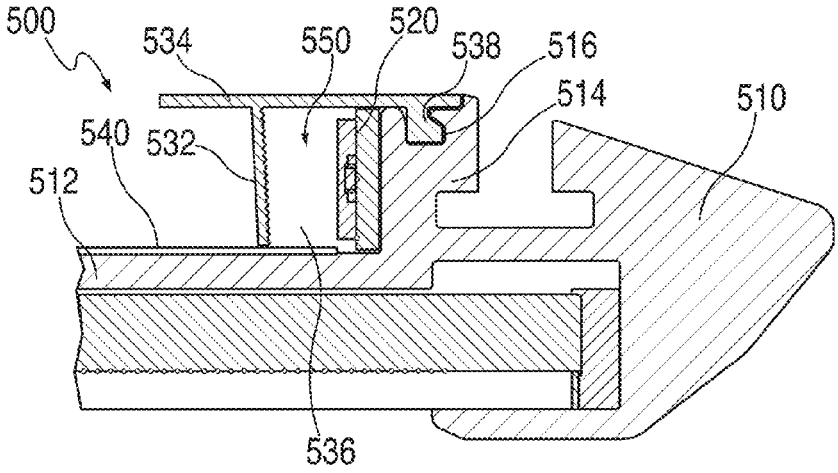
FIG. 5 is a sectional view of a light well used with a LED luminaire in accordance with some embodiments of the invention.

FIG. 5 is a sectional view of a light well used with a LED luminaire in accordance with some embodiments of the invention. LED luminaire 500 can include some or all of the features of other luminaires described herein. Luminaire 500 can include frame 510 having center plate 512 bound on one end by side wall 514. LED module 520 can be secured to wall 514 such that light emitted by LED module 520 is emitted generally parallel to center plate 512 (e.g., perpendicular to a surface of side wall 514 that is itself perpendicular to center plate 512.

To provide a wide radiation pattern, luminaire 500 can include light well 540 operative to redirect light emitted from LED module 520. Light well 540 can include lens 530 and reflective layer 540 disposed at least partially within cavity 536 enclosed by lens 530.

Lens 530 can include lens region 532 through which light may be transmitted with particular optical properties. Lens region 532 may extend from lens base 534 at any suitable angle (e.g., an angle of or near 90 degrees) such that lens region 532 and lens base 534 can form two sides of a cavity 536 of light well 550. In some cases, lens 530 can be secured to frame 510 such that lens region 532 is substantially perpendicular or angled relative to center plate 512, and lens base 534 can be substantially parallel to center plate 512.

Lens 530 can be coupled to frame 510 using any suitable approach. In some cases, lens 530 can include protrusion 538 extending from lens base 534. Protrusion 538 can extend from lens base 534 at any suitable angle. For example, protrusion 538 can extend substantially perpendicular to lens base 534. As another example, protrusion 538 can extend in the same plane as lens base 534. As still another example, protrusion 538 and lens region 532 can extend from a same surface of lens base 534. Protrusion 538 can have any suitable shape including, for example, a shape having a lip, return, or other feature operative to engage a corresponding feature of frame 510. In particular, frame 510 can include slot 516 within side wall 514 having a counterpart feature for engaging protrusion 538. Protrusion 538 and slot 516 can be shaped such that lens 530 can be slid into slot 516. For example, lens 530 can be slid into frame 510 along the length of luminaire 500. Lens 530 can then be prevented from sliding out of luminaire 500 by end caps. Using this approach, lens 530 can be constructed by an extrusion process, which may provide cost savings.

Figure 6:
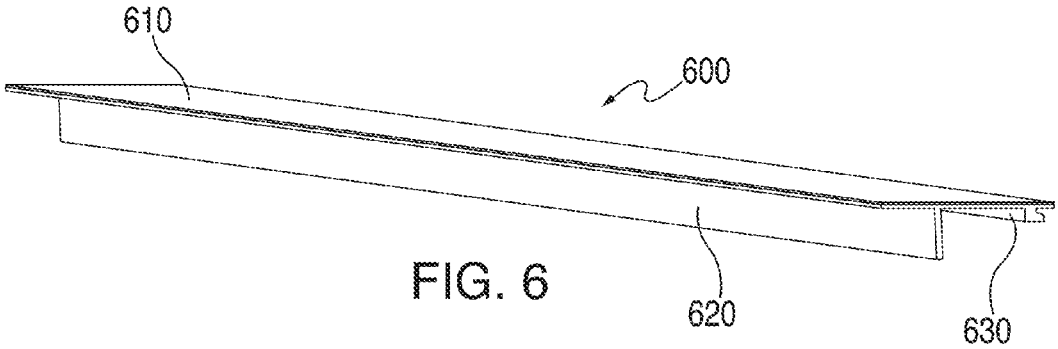
FIG. 6 is a perspective view of an illustrative lens used in a light well in accordance with some embodiments of the invention.
Figure 7:
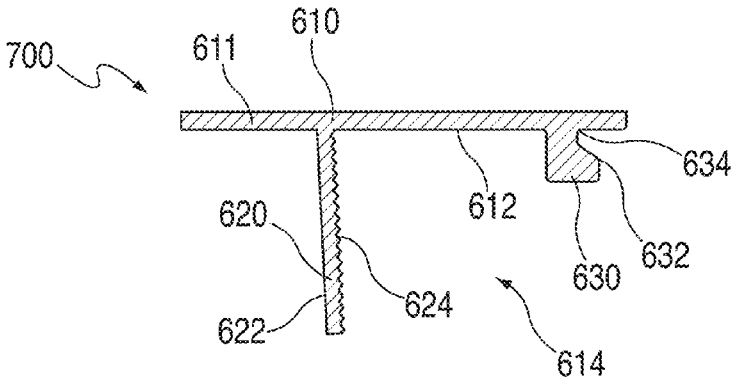
FIG. 7 is a sectional view of the illustrative lens of FIG. 6 in accordance with some embodiments of the invention.

The lens can include different features for modifying light emitted by the luminaire. FIG. 6 is a perspective view of an illustrative lens used in a light well in accordance with some embodiments of the invention. FIG. 7 is a sectional view of the illustrative lens of FIG. 6 in accordance with some embodiments of the invention. Lens 600 can include lens base 610 defining a planar region that is substantially parallel to a center plate of the luminaire. Lens base 610 can be at least partially opaque to prevent light from being transmitted through the lens base. For example, a reflective layer (e.g., a white diffusive layer) can be provided on one or both surfaces of lens base 610 to reflect light, such that lens base 610 forms a reflective region of lens 600. In some cases, the reflective layer can be provided on a lower or interior surface of lens base 610 (e.g., surface 612) to cause light emitted by a light source to reflect within volume 614 enclosed by lens 600 in the light well. In some cases, the material selected for the reflective layer can provide at least 92% reflectivity (e.g., 95% or 98% reflectivity).

Alternatively, lens base 610 can be constructed so that surface 612 can include an at least partially transmitting surface. For example, surface 612 can have a transmittance in the range of 1% to 5%. In some cases, a reflective layer that includes several openings or hoes can be provided to ensure that at least some light may be transmitted through the reflective layer.

Because light may be reflected by lens base 610, another surface or portion of lens 600 may need to transmit light. Primary lens region 620 may be constructed from an optically transparent or translucent material to provide a transmittance region for the lens. Lens region 620 can extend from lens base 610 at any suitable angle. For example, lens region 620 can extend substantially perpendicular to lens base 610. In some cases, lens region 620 can be slightly angled relative to perpendicular to lens base 610. For example, lens region 620 can be angled at 5 degrees towards a LED module (e.g., towards a wall of a frame) relative to a normal to lens base 610. Lens region 620 can extend from any suitable portion of lens base 610, including from an end of lens base 610 or from an intermediate region. In the example of FIGS. 6 and 7, lens region 620 can extend from an intermediate region of lens base 610 such that lens base 610 includes overhang or extension 611 having an opaque surface redirecting some light transmitted through lens region 620.

Lens region 620 can include different features for controlling the manner in which light is transmitted through the lens. For example, lens region 620 can include a substantially smooth outer surface 622, and a rough inner surface 624. Rough inner surface 624 can include any suitable regular or arbitrary feature. For example, a grinder or other tool can roughen inner surface 624 to create a diffuse layer. In some cases, inner surface 624 can include regular features that define a non-planar surface. For example, inner surface 624 can include sequence of triangular or pyramidal features distributed along the surface (e.g., a sequence of isosceles triangular shapes having 40 degree base angles). In some cases, lens region 620 can be constructed to have at least 92% transmittance (e.g., 95% or 98% transmittance) so that most light emitted by a light module may pass through lens region 620.

Lens 600 can include protrusion 630 extending from lens base 610 for securing lens 600 to a frame. Protrusion 630 can extend from any suitable portion of lens base 610 such as, for example, an end or tip of the lens base. In this manner, a LED module used with lens 600 can be located between lens portion 620 and protrusion 630. Protrusion 630 can include features 632, such as a recess, for engaging a counterpart feature of a frame. In some cases, protrusion 630 can have substantially the same cross-section throughout lens 600 so that lens 600 can be slid into the frame. Such a lens may be constructed by an extrusion process that makes use of a die defining protrusion 630.

Lens 600 can be constructed from any suitable material. In some cases, lens 600 can be constructed from an optically transparent or translucent material. Such materials can include, for example, an acrylic, polycarbonate, glass, or another plastic material that is substantially transparent can be used. In some cases, the material used can be selected based on a desired manufacturing process. In other cases, the material and/or manufacturing process used can be selected based on additional processes used to create the lens (e.g., materials for which a reflective layer can be easily coated on a portion of lens 600).

Figure 8:
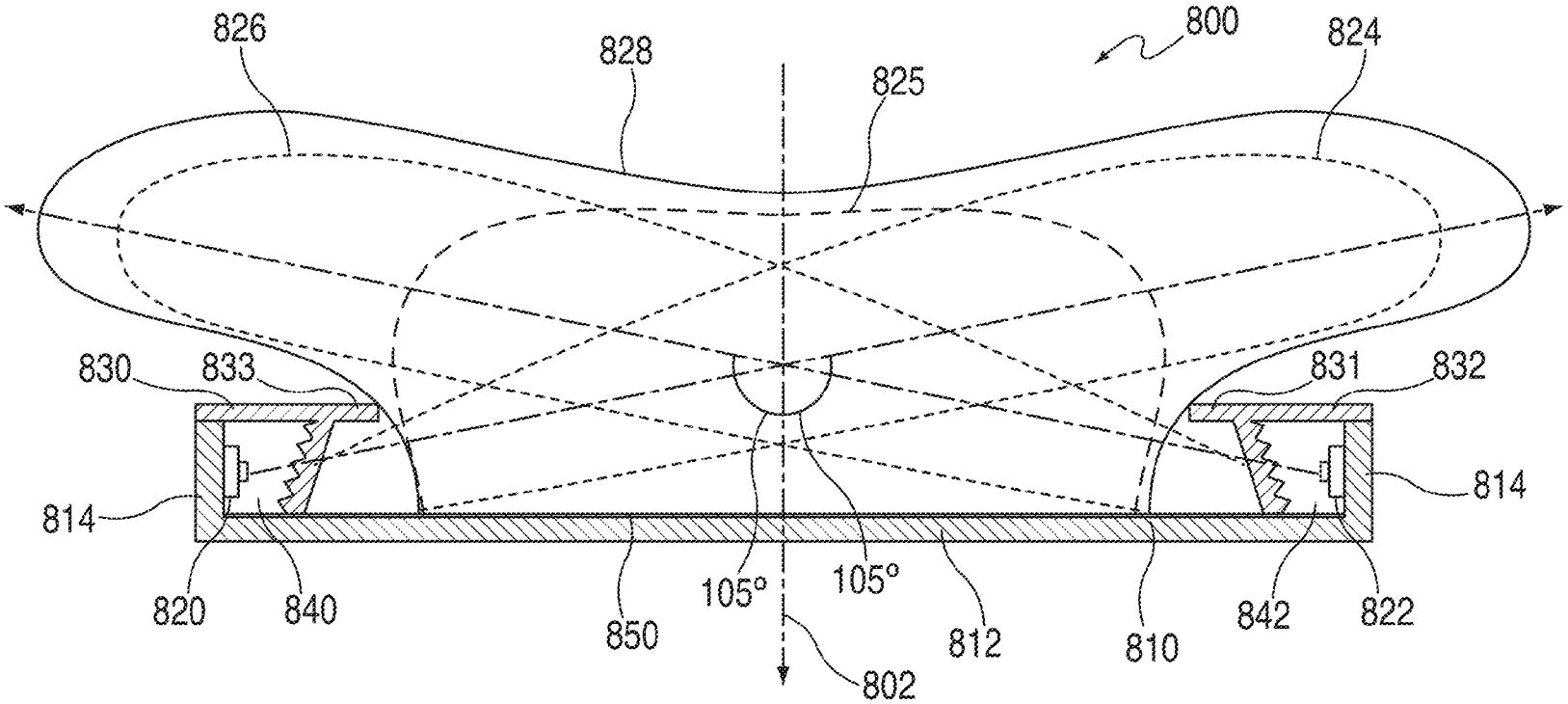
FIG. 8 is a sectional view of a portion of an illustrative LED luminaire having a light well in accordance with some embodiments of the invention.

By using two sets of lens with LED modules positioned facing each other, a LED luminaire can provide a desired wide angle radiation pattern. FIG. 8 is a sectional view of a portion of an illustrative LED luminaire having a light well in accordance with some embodiments of the invention. Luminaire 800 can include frame 810 having center plate 812 and side walls 814. LED modules 820 and 822 can be mounted to each side wall 814 such that the LED modules substantially face each other. Luminaire 800 can include light well 840 corresponding to LED module 820, and light well 842 corresponding to LED module 822. Light well 840 can include lens 830, and light well 842 can include lens 832, each lens having some or all of the features of the lens described above in connection with FIGS. 6 and 7).

Light emitted by LED module 820 can initially be provided as light from a point source that is emitted over a large surface corresponding to lens 830 to form lobe 824 extending away from side wall 814 of LED module 820 towards LED module 822. Similarly, light emitted by module 822 can initially be provided as light from a point source this is emitted over a large surface corresponding to lens 832 to form lobe 826 extending away from side wall 814 of LED module 822 towards LED module 820.

Lobes 824 and 826 can be angled by any suitable amount relative to normal axis 802 (e.g., the nadir of luminaire 800). For example, each of lobes 824 and 826 can be angled substantially at 105 degrees relative to normal axis 802. In some cases, lobes 824 and 826 can be oriented such that the lobes are largest between angles of 100 degrees and 120 degrees relative to normal axis 802. The particular angle of lobes 824 and 826 can be in part determined by the angle and length of extensions 831 and 833, which can include portions of lens bases extending beyond lens regions of each of lens 830 and 832.

Some light emitted by each of LED modules 820 and 822, once transmitted through lens 830 and 832, respectively, may not directly exit luminaire 800 as one of lobes 824 and 826, but may instead be transmitted toward center plate 812 between lens 830 and 832. The light may then be reflected by center plate 812 to form center lobe 825. The combination of lobes 824, 825, and 826 can generate radiation pattern 828, which can correspond to the desired wide angle radiation pattern for luminaire 800. In some cases, some light may be transmitted through a lens base of lens 830 and 832 to provide a more full radiation pattern 828 above LED modules 820 and 822.

To improve the performance of luminaire 800, different surfaces of luminaire 800 can be coated with a highly reflected and diffuse layer. For example, a white layer can be applied to different surfaces of luminaire 800. In particular, luminaire 800 can include reflective layer 850 applied to an upper surface of center plate 812 between each of lens 830 and 832. In this manner, the light transmitted by each lens towards center plate 812 may be more efficiently reflected up and out of luminaire 800. In some cases, the reflective layer can be selected to have at least 92% reflectivity (e.g., 95% or 98% reflectivity). Layer 850 can be provided using any suitable approach including, for example, as a deposited coating, as a layer of material adhered to center plate 812, or as a layer of material placed over center plate 812 and retained by lens 830 and 832 (e.g., layer 850 extends at least partially into light wells 840 and 842.

In some cases, it may be desirable to improve the performance of luminaire 800 by providing light transmitted from light wells 840 and 842 not as a point source, as provided by the LED modules, but as a region of light. To do so, it may be desirable to cause emitted light to reflect within light wells 840 and 842 (e.g., the light wells providing highly reflective cavities to improve the efficiency of the luminaire). Light may reflect internally until the light reaches lens regions of each of lens 830 and 832 and is emitted from the light wells through the entireties of the lens regions.

Different approaches can be used to improve the reflectivity of inner surfaces of light wells 840 and 842. In some cases, a reflective layer can be provided on portions of center plate 812 that are within a volume enclosed by lens 830 and 832. For example, the reflective layer applied to portions of center plate 812 between lens 830 and 832 can extend on the entirety of center plate 812 between side walls 814. In some cases, a reflective layer can be applied to portions of side wall 814 that are not covered by LED modules 820 and 822. In some cases, a reflective layer can be applied to portions of lens 830 and 832 other than the transparent or translucent lens region (e.g., the layer is partially or entirely applied to surfaces of lens 830 and 832 that are substantially parallel to center region 812). In some cases, a reflective layer can be applied to a lower or upper surface of extensions 831 and 833 to ensure that the extensions are opaque and redirect light transmitted from the lens regions.

Figures 9A, 9B:
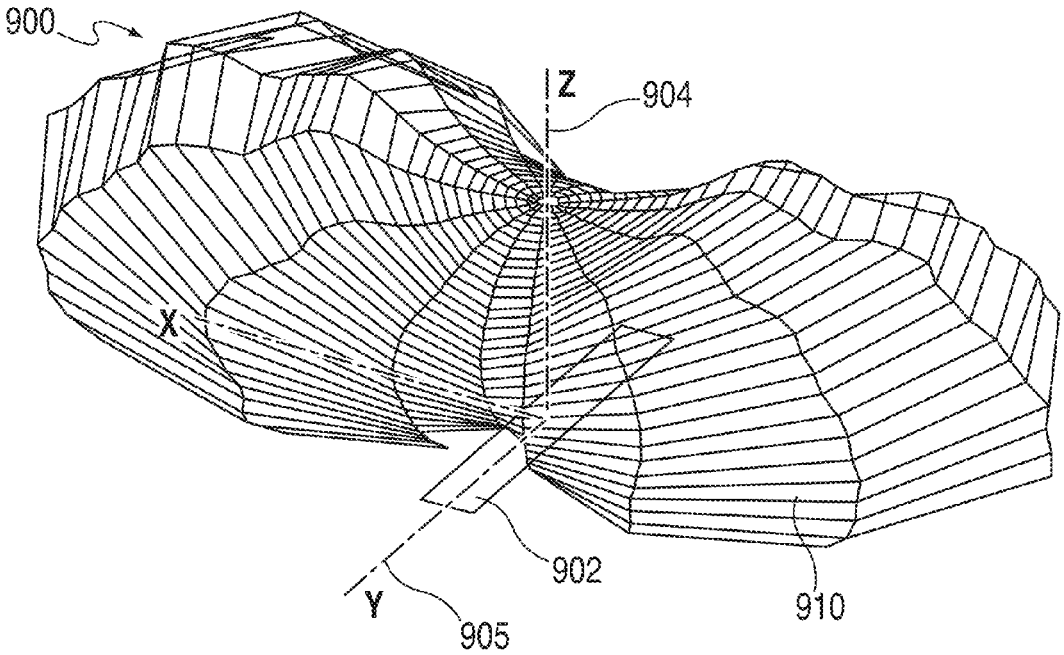
FIG. 9A is a schematic view of a representation of up illumination provided by an illustrative LED luminaire having light wells in accordance with some embodiments of the invention.
FIG. 9B is a table indicating the amount of light emitted in different regions represented in FIG. 9A in accordance with some embodiments of the invention.

FIG. 9A is a schematic view of a representation of up illumination provided by an illustrative LED luminaire having light wells in accordance with some embodiments of the invention. Representation 900 can include three-dimensional shape 910 representing the lumens, or amount of light, emitted by a luminaire positioned as shown by outline 902. Each zone angle represents an angular section (e.g., a triangular section having a point on the origin of the coordinate system of outline 902 and edges at the defined angles relative to y-axis 905) that is swept around z-axis 904. Each zone angle therefore is represented in FIG. 9A by a ring-shaped surface at a particular distance from the origin, where the distance is determined from the illumination provided by the luminaire between the angles of the zone angle. FIG. 9B is a table indicating the amount of light emitted in different regions rotated around z-axis 904 of the luminaire as measured relative to y-axis 905. Table 920 includes zone angles column 922, lumens column 924 providing a measurement of illumination for each zone angle, and percentage column 926 providing the percentage of illumination provided by the luminaire at each zone angle. As can be seen by table 920, the zone angle for which the most illumination is provided is between 100 degrees and 110 degrees, with the majority of all illumination provided between 100 degrees and 130 degrees (e.g., at wide angles).

Figure 10A:
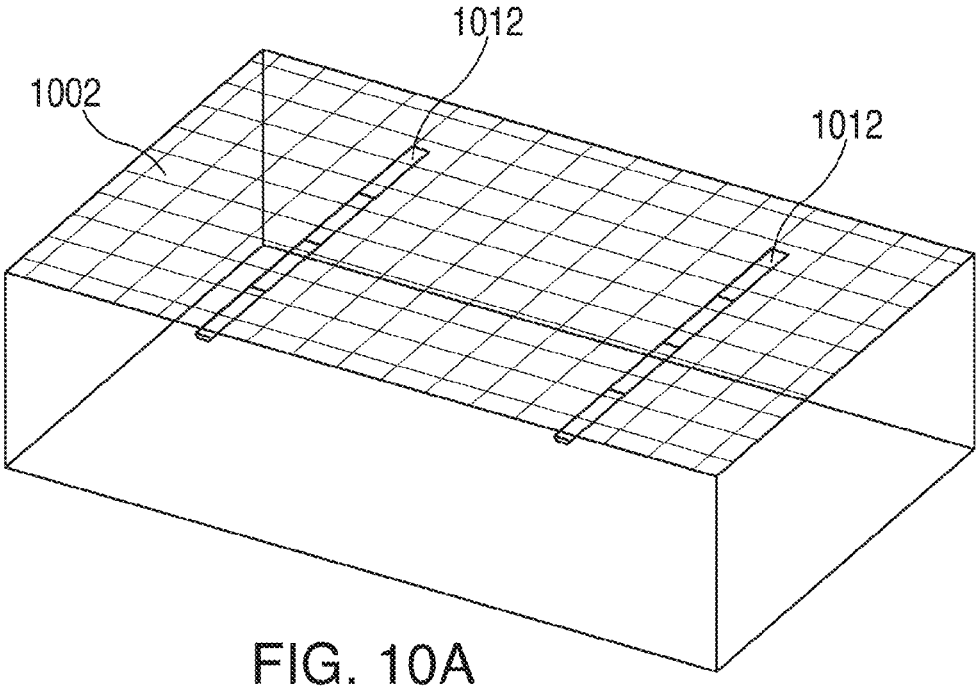
FIGS. 10A and 10B show a room in which LED luminaires have be provided in accordance with some embodiments of the invention.
Figure 10B:
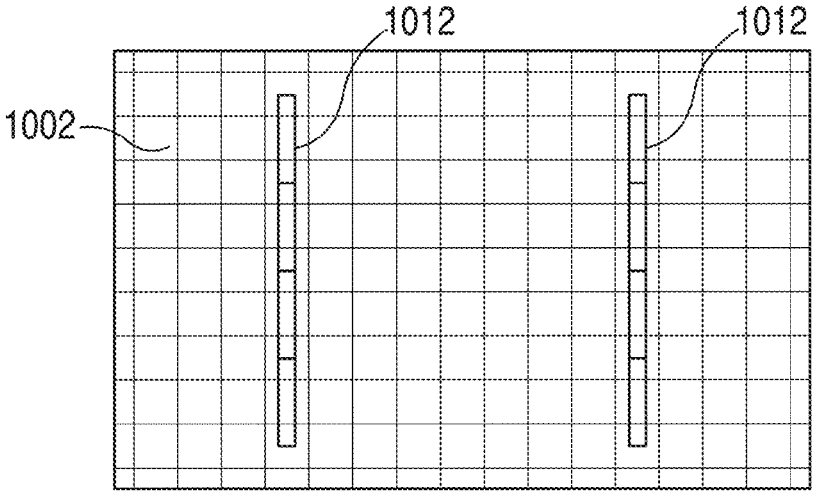

Using a luminaire in accordance with embodiments of the invention, fewer luminaires may be necessary to illuminate a room while meeting the recommended practice of ANSI/IESNA described above. In particular, the luminaires may provide up light at such wide angles that luminaires can be spaced further apart while satisfying the ceiling luminance ratio, thus reducing costs for illuminating a room. FIGS. 10A and 10B show a room in which LED luminaires have be provided in accordance with some embodiments of the invention. Room 1002 can have any suitable dimensions including, for example, 32'×20'×9'. Luminaires 1010 and 1012 can each include 4 distinct 4' luminaires or modules placed end to end and connected to each other to form a luminaire unit having a length of 16'. The luminaire units can be spaced 16' apart, and suspended 18" from the ceiling (e.g., luminaires 1010 and 1012 are each 8' from a wall). In this configuration, the luminaire units can provide an average illumination of 31.1 foot candles on a work plane, and have an average ceiling luminance ratio of 3.6:1, which far exceeds the recommended practice of ANSI/IESNA described above.

Figure 11:
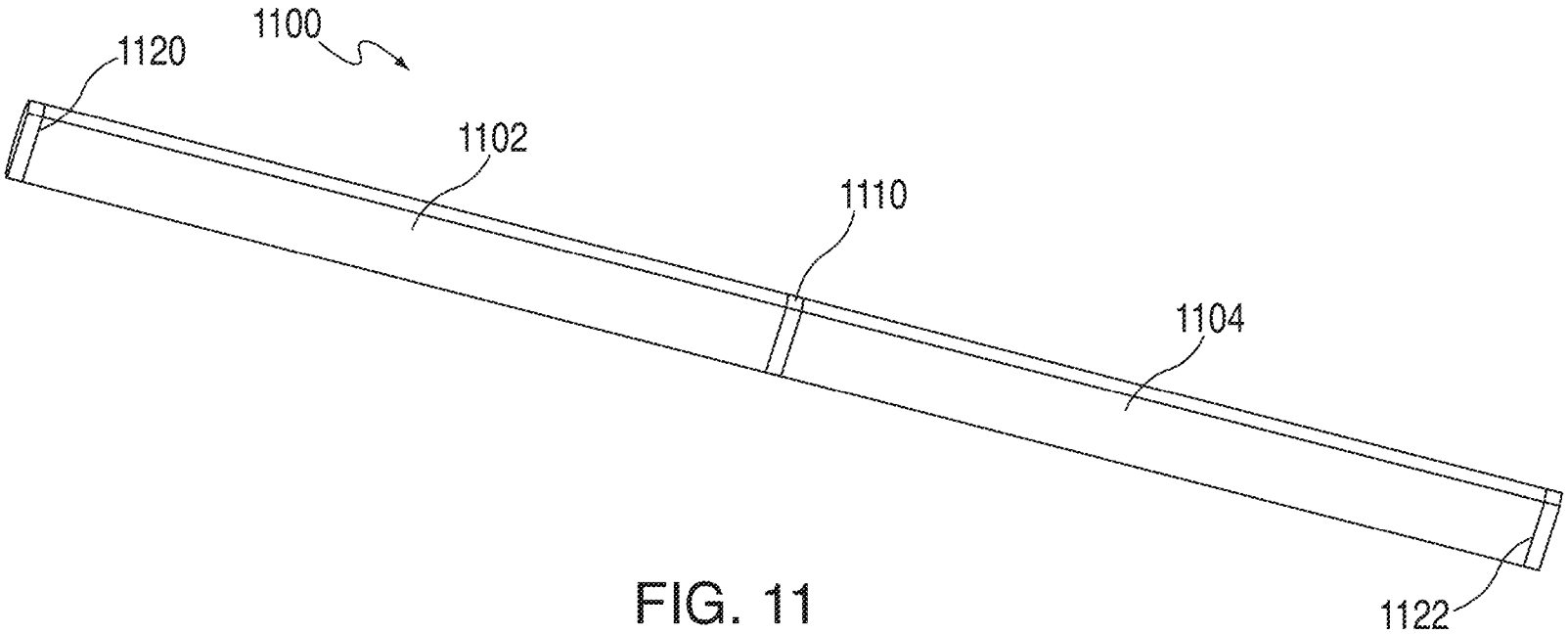
FIG. 11 is a perspective view of two connected LED luminaire modules in accordance with some embodiments of the invention.
Figure 12:
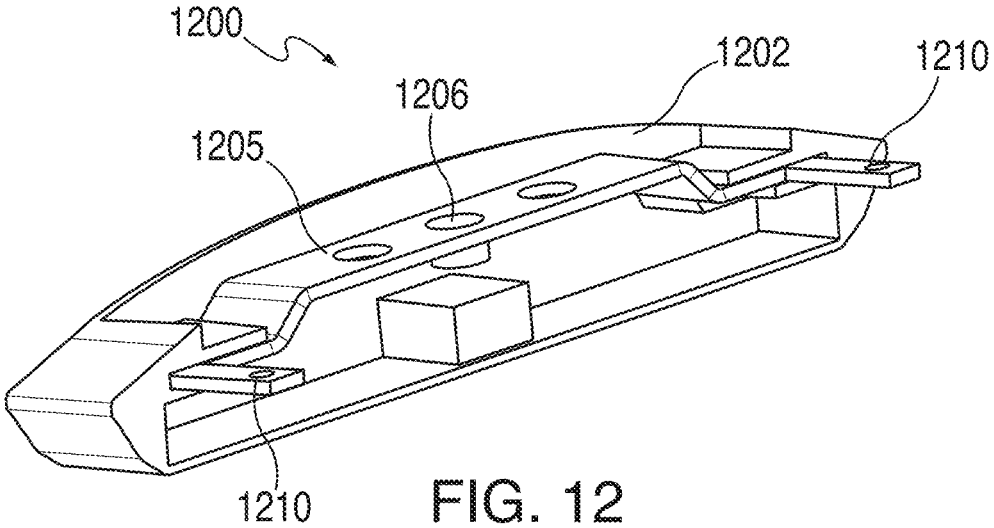
FIG. 12 is a perspective view of an illustrative end piece for a LED luminaire in accordance with some embodiments of the invention.
Figure 13:
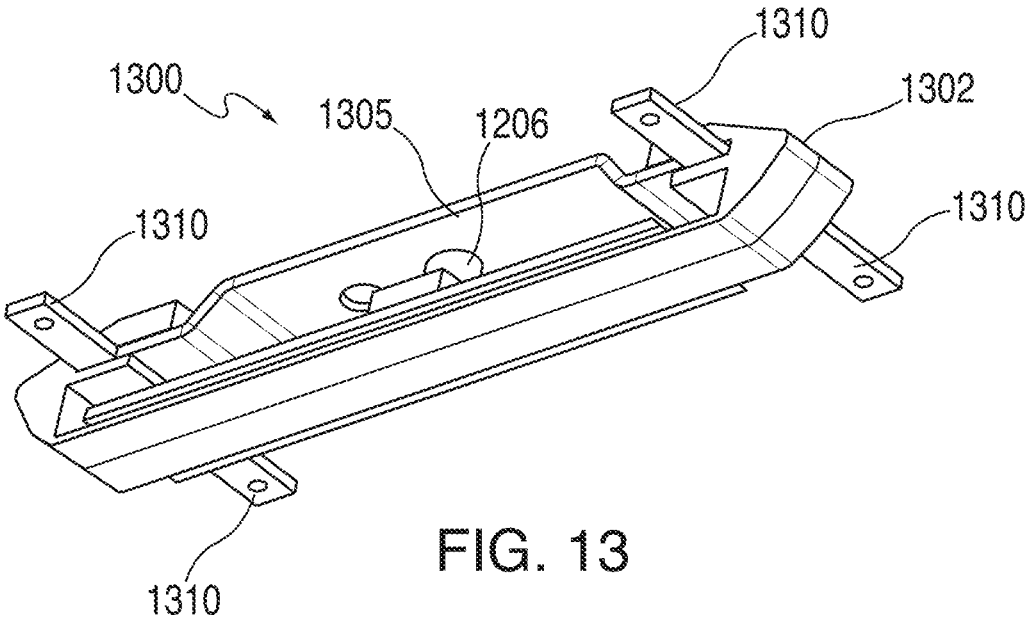
FIG. 13 is a perspective view of an illustrative connecting piece for LED luminaires in accordance with some embodiments of the invention.

To provide such long luminaire units in an aesthetically pleasing manner, connectors can be used to connect several luminaires (e.g., connect several luminaire modules). FIG. 11 is a perspective view of two connected LED luminaires forming a luminaire unit in accordance with some embodiments of the invention. FIG. 12 is a perspective view of an illustrative end piece for a LED luminaire in accordance with some embodiments of the invention. FIG. 13 is a perspective view of an illustrative connecting piece for LED luminaires in accordance with some embodiments of the invention. Luminaire unit 1100, shown in FIG. 11, can include distinct luminaire modules 1102 and 1104 connected electrically and structurally by connector 1110. At each end of luminaire 1100, end caps 1120 and 1122 can be provided.

Luminaire unit 1100 can be mounted to a ceiling or other fixture using any suitable approach. In some cases, connector 1110 and end caps 1120 and 1122 can include the components used to mount luminaire 1100 to a ceiling. For example, connector 1110 and end caps 1120 and 1122 can each include structural plates having an opening or other feature for receiving mounting brackets, as described above. This approach may ensure that the non-optic mounting brackets do not interfere with the optical performance of light wells or other optical components of the individual luminaire modules.

In some cases, the end caps and connectors can be constructed to have similar external appearances to improve the cosmetic appeal of luminaire 1100. For example, end cap 1200 of FIG. 12 and connector 1300 of FIG. 13 can each include external bodies 1202 and 1302, respectively, that have similar shapes and colors. The external bodies 1202 and 1302 can be constructed from any suitable material including, for example, plastic. In some cases, the external bodies can be molded (e.g., overmolded) using similar molds to ensure that the shape and dimensions of cap 1200 and connector 1300 are similar and aesthetically pleasing. In some cases, finishing or refining processes can be used to enhance the aesthetic appeal of the end cap and connector.

In some cases, each of end cap 1200 and connector 1300 can also include structural or electrical elements for providing power and/or mechanical structure to the different modules of luminaire 1100. For example, end cap 1200 can include center plate 1205, and connector 1300 can include center plate 1305. Each plate can include features for receiving a mounting bracket (e.g., opening 1206 in plate 1205, or opening 1306 in plate 1305), or for receiving other structural components of a luminaire unit. In some cases, plate 1205 can include can include one or more tabs 1210 extending perpendicular to the plate to engage a luminaire modules to which cap 1200 is connected. Similarly, plate 1305 can include one or more tabs 1310 extending from different sides of plate 1305 for engaging several luminaire modules that are connected using connector 1300. The tabs can serve to provide structure, and/or can include electrically conductive paths for transferring power or data between luminaire modules.

Figure 14A:
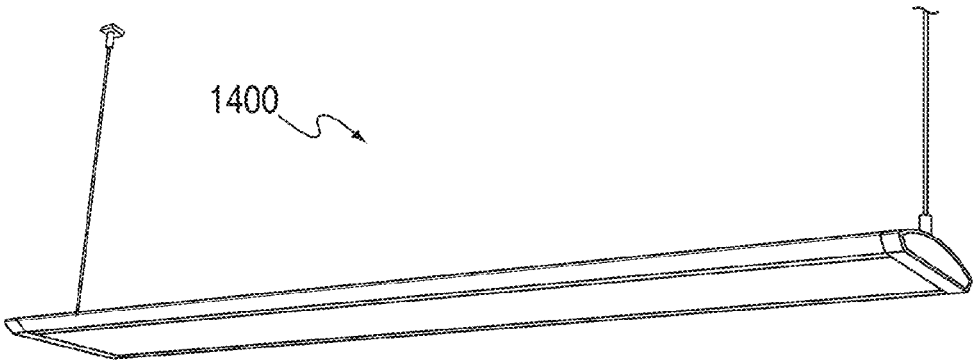
FIGS. 14A-14F are schematic views of illustrative LED luminaires providing wide angle up lighting in accordance with some embodiments of the invention.
Figure 14B:
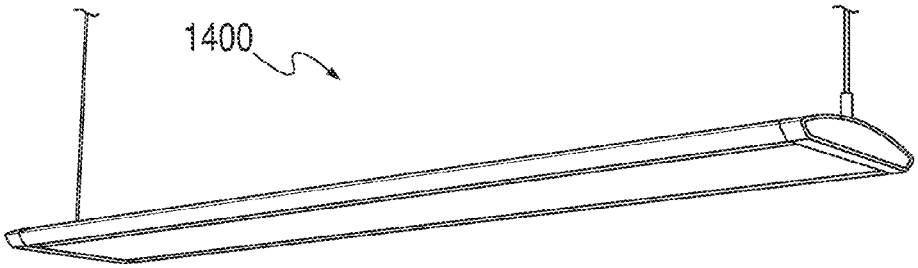
Figure 14C:
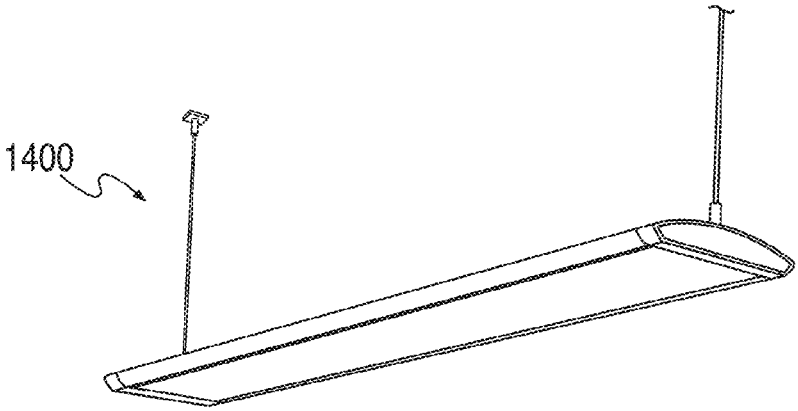
Figure 14D:
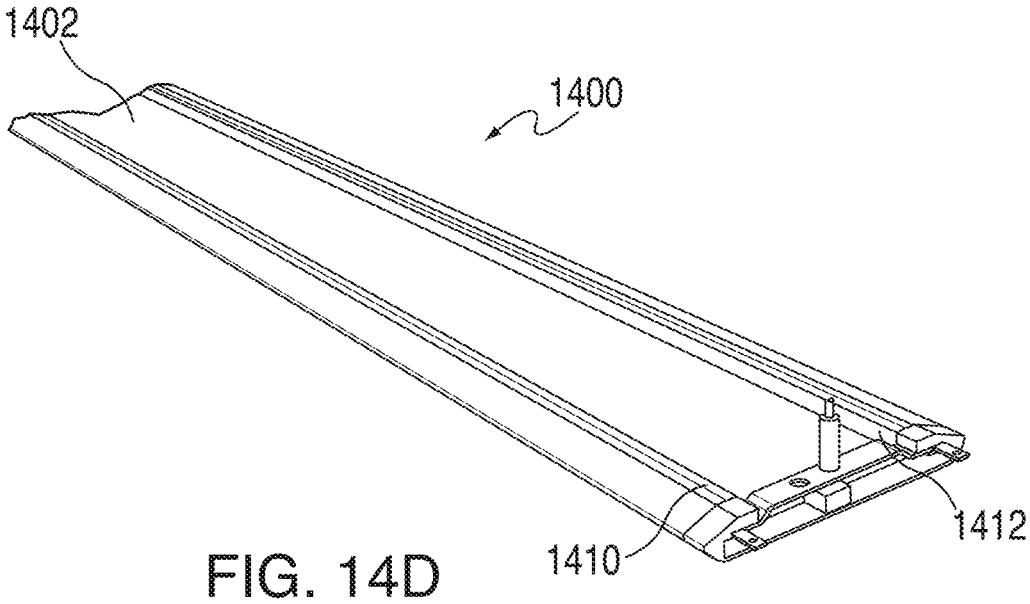
Figure 14E:
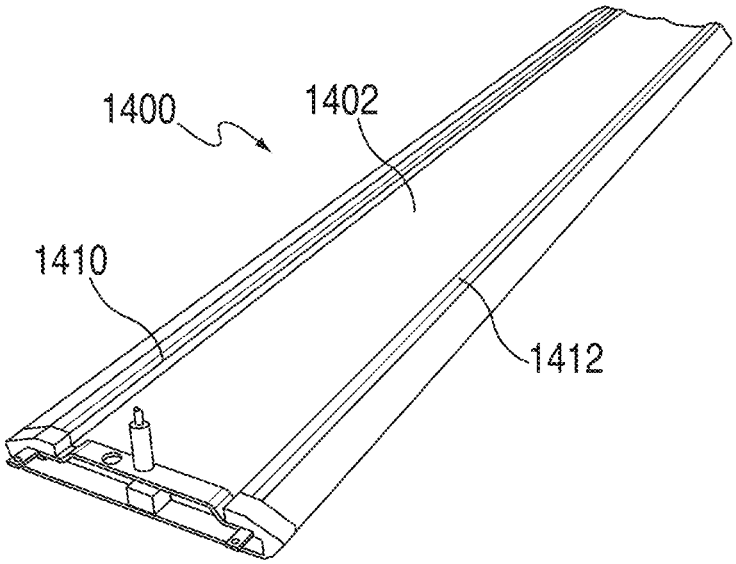
Figure 14F:
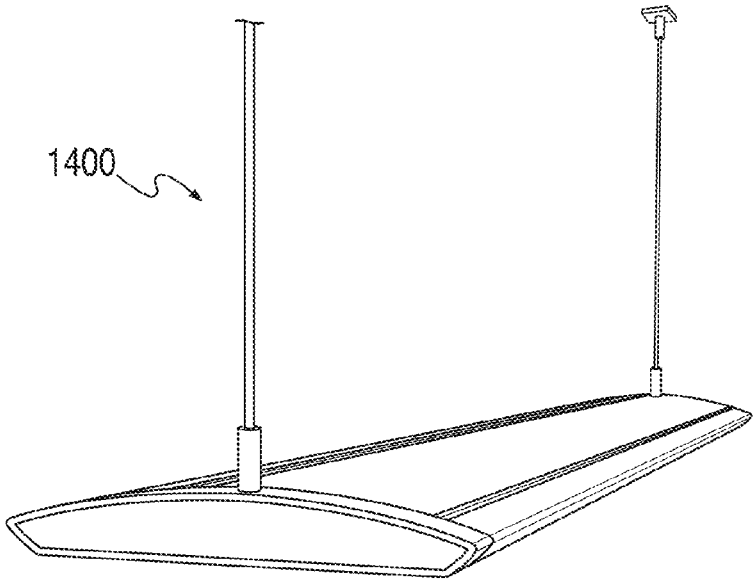

FIGS. 14A-14F are schematic views of illustrative LED luminaires providing wide angle up lighting in accordance with some embodiments of the invention. Luminaire 1400 can include LED light modules for providing down light, as primarily shown in FIGS. 14A-14C, and can also include LED light modules for providing up light, as primarily shown in FIGS. 14D-14F. As can be seen in FIGS. 14D-14F, the LED light modules providing up light can be disposed in two rows

1410 and 1412 extending along the length of luminaire 1400, positioned opposite one another with intermediate region 1402 between the LED light modules illuminated by each of the rows of LED light modules.

Figure 14G:
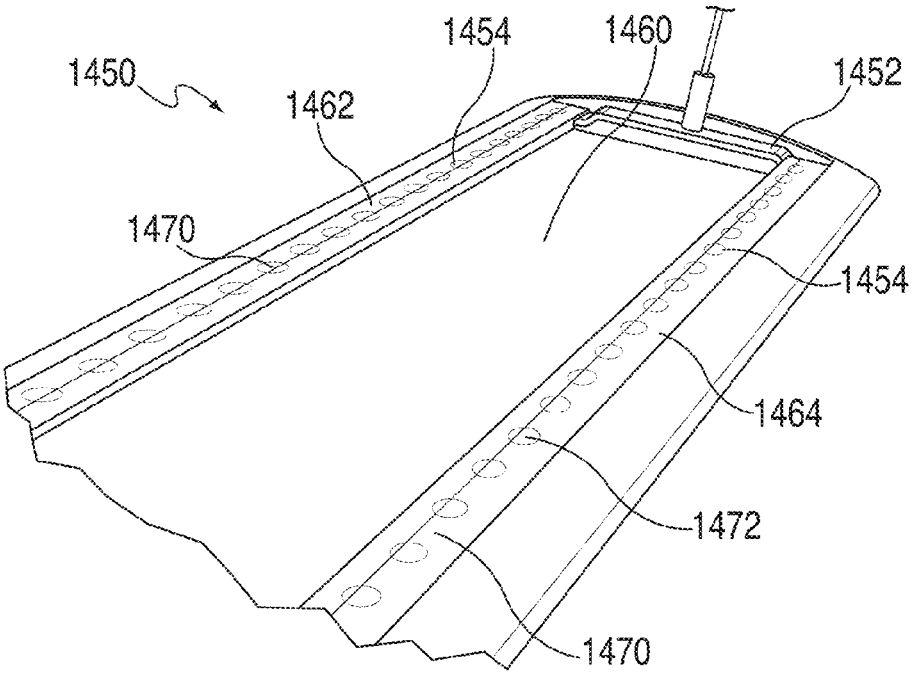
FIG. 14G is a perspective view of an upper surface of a luminaire in accordance with some embodiments of the invention.

FIG. 14G is a perspective view of an upper surface of a luminaire in accordance with some embodiments of the invention. Luminaire 1450 can include some or all of the features of luminaires described herein. Luminaire 1450 can include frame 1452 for supporting LED modules 1454. Frame 1452 can include center plate 1460 between light wells 1462 and 1464. Each light well can include lens 1470 having lens base 1472 forming a planar surface such that LED modules 1454 is between the plans of lens base 1472 and center plate 1454.

In some cases, lens base 1472 can be at least partially transmissive so that some light emitted by LED modules 1454 can be transmitted through lens base 1472 in addition to through a primary lens surface extending from the lens base. For example, lens base 1472 can have a transmission in the range of 1% to 5%, which may be detected by the light regions in base 1472 of luminaire 1450, depicting the positions of LED modules 1454 within the luminaire. This may improve the light pattern provided by luminaire 1450 relative to a luminaire having a completely reflective lens base 1472, for example by providing a smooth transition between dark and bright regions above the fixture. A surface of lens base 1472, however, can be at least partially coated with a reflective layer to enhance some reflectivity of the lens base.

Figure 15A:
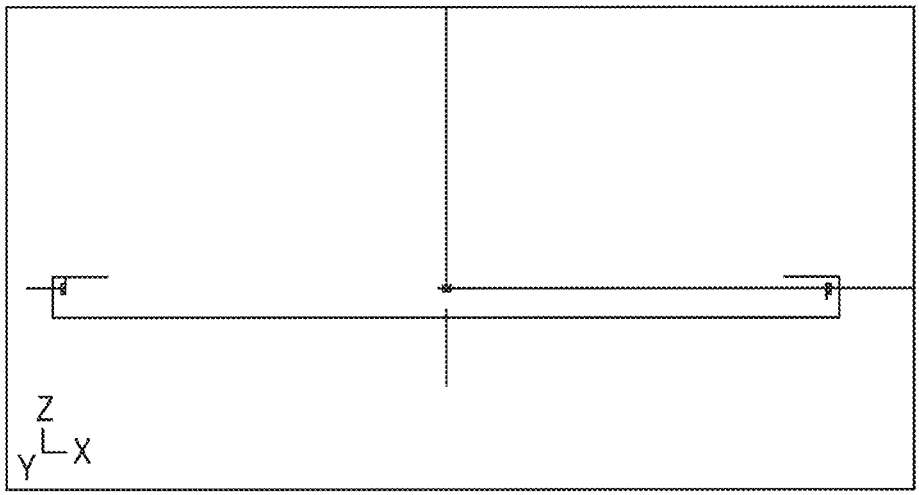
FIG. 15A shows a schematic side view of a portion of an illustrative luminaire in accordance with some embodiments of the invention.
Figure 15B:
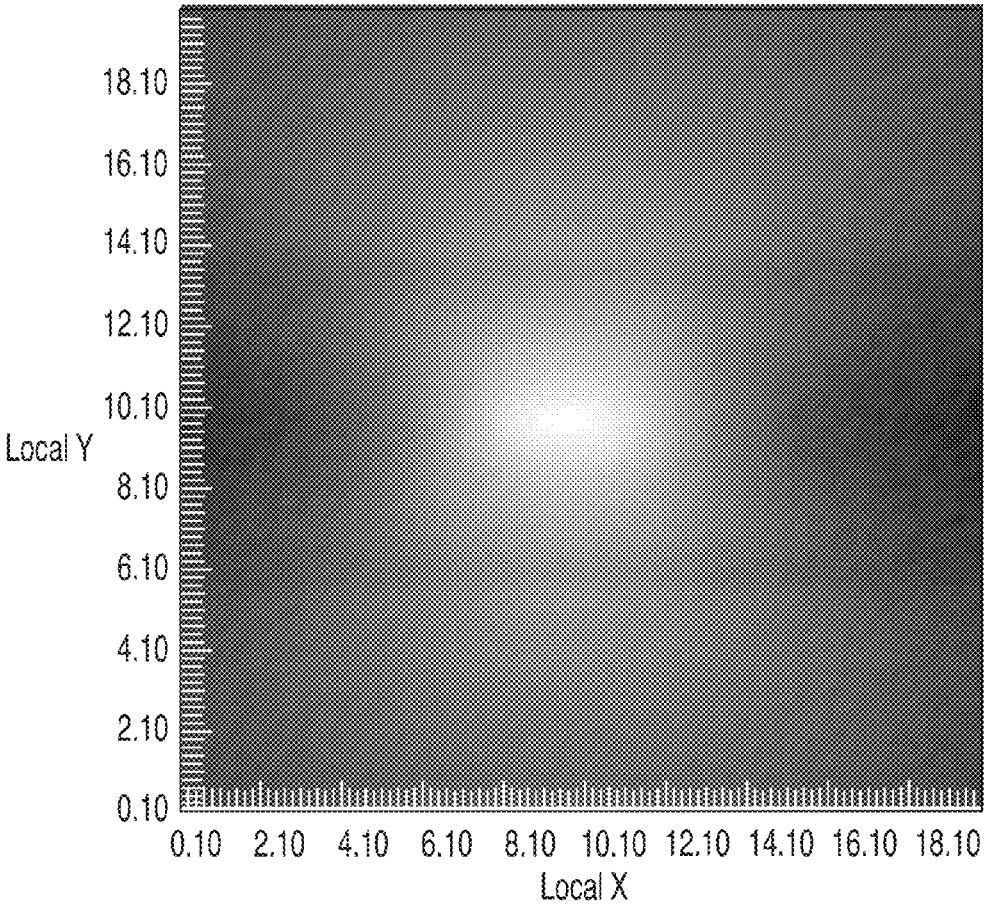
FIG. 15B is a schematic view of an illustrative illumination pattern on a ceiling above the luminaire of FIG. 15A in accordance with some embodiments of the invention.
Figure 15C:
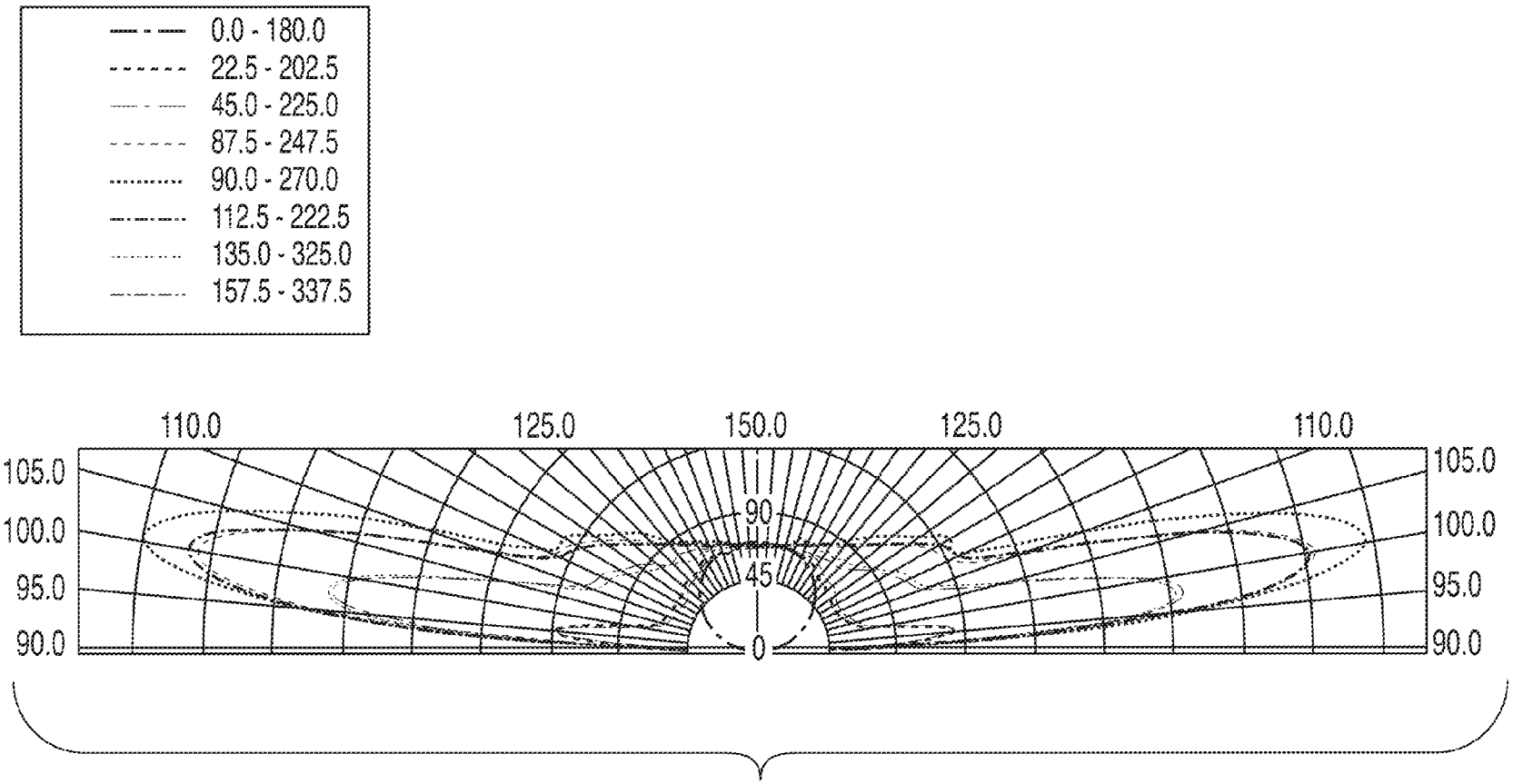
FIG. 15C is an illustrative radiation pattern for light emitted by the luminaire of FIG. 15A in accordance with some embodiments of the invention.

Although FIGS. 1-14 show a particular structure for the luminaire and the lens, other structures can be used to generate wide angle up lighting. In particular, other structures can have at least some features of the light wells described above. FIG. 15A shows a schematic side view of a portion of an illustrative luminaire in accordance with some embodiments of the invention. The luminaire can include no lens, but an extension extending over and parallel to edge lighting LED modules. In some cases, the extension can be opaque to control the angle at which light is emitted from the luminaire. FIG. 15B is a schematic view of an illustrative illumination pattern on a ceiling above the luminaire of FIG. 15A in accordance with some embodiments of the invention. The light pattern can include a central light region, but also some dark regions near ends of the luminaire. FIG. 15C is an illustrative radiation pattern for light emitted by the luminaire of FIG. 15A in accordance with some embodiments of the invention.

Figure 16A:
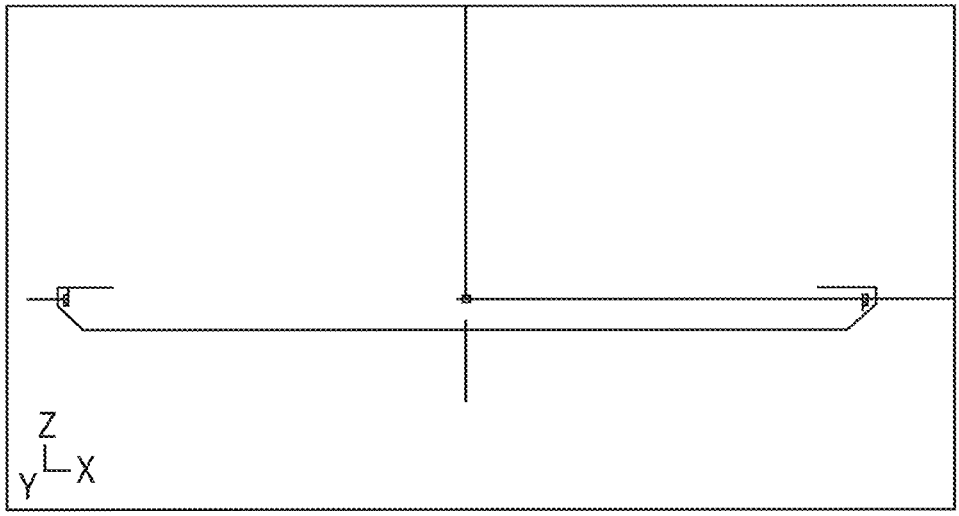
FIG. 16A shows a schematic side view of a portion of an illustrative luminaire in accordance with some embodiments of the invention.
Figure 16B:
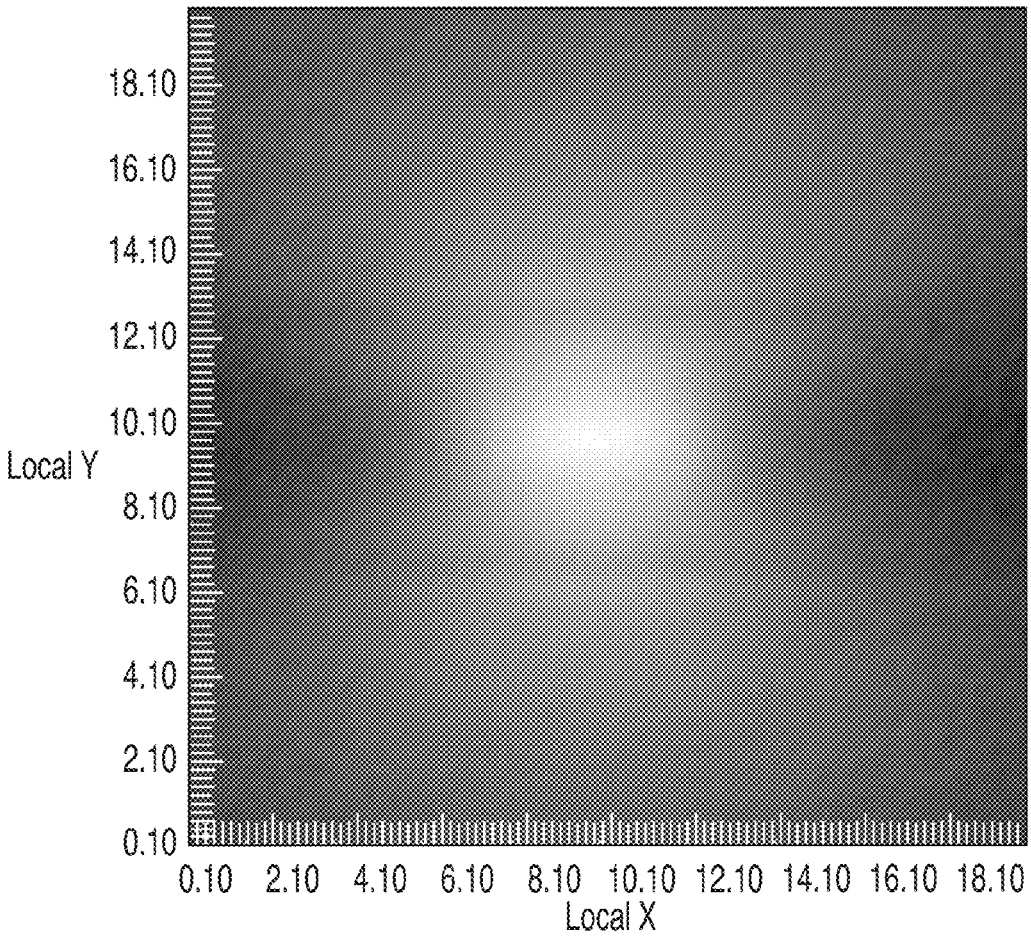
FIG. 16B is a schematic view of an illustrative illumination pattern on a ceiling above the luminaire of FIG. 16A in accordance with some embodiments of the invention.
Figure 16C:
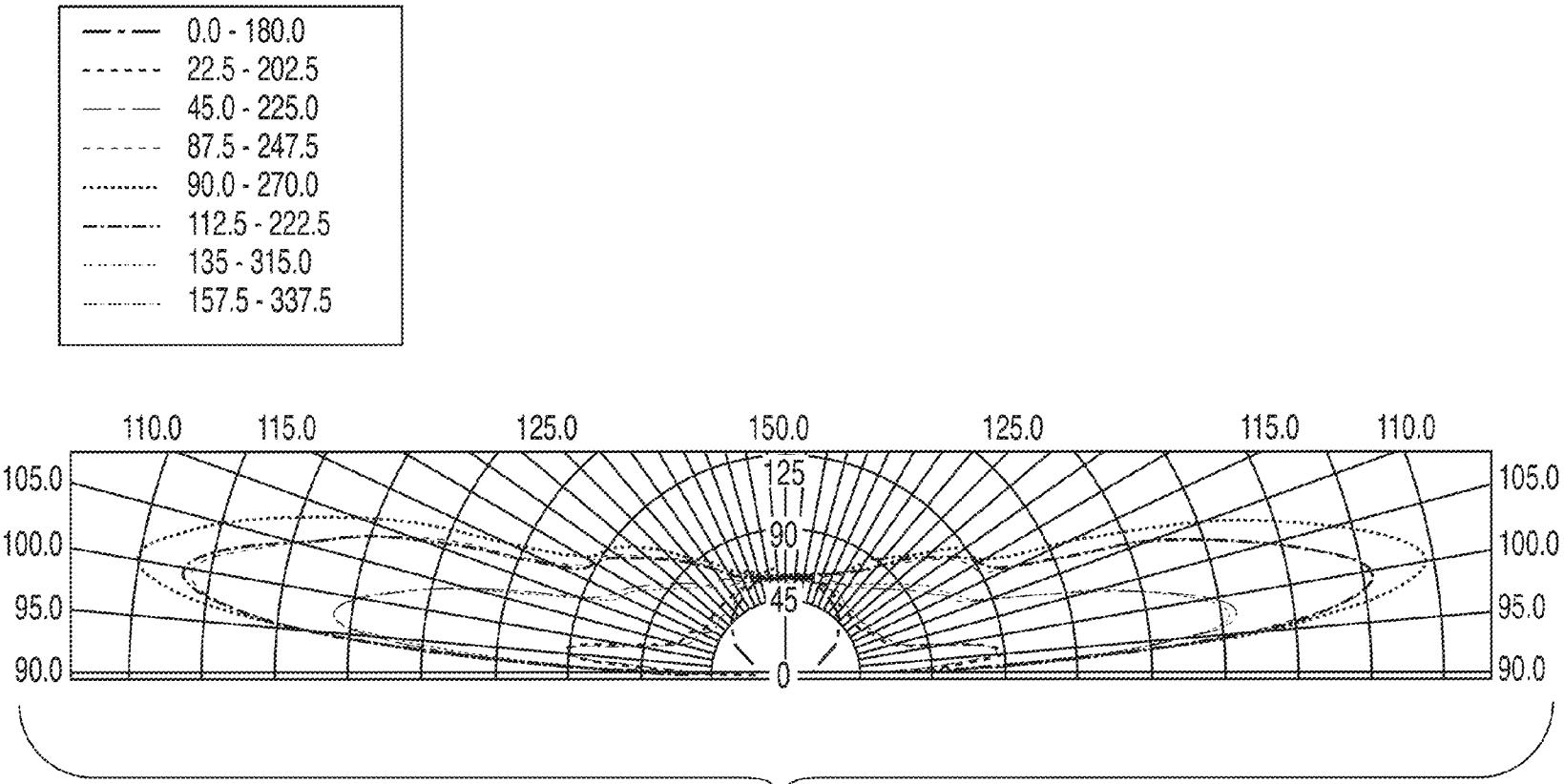
FIG. 16C is an illustrative radiation pattern for light emitted by the luminaire of FIG. 16A in accordance with some embodiments of the invention.

FIG. 16A shows a schematic side view of a portion of an illustrative luminaire in accordance with some embodiments of the invention. The luminaire can include no lens, an extension extending over and parallel to edge lighting LED modules, and a curved frame. In some cases, the extension can be opaque to control the angle at which light is emitted from the luminaire. FIG. 16B is a schematic view of an illustrative illumination pattern on a ceiling above the luminaire of FIG. 16A in accordance with some embodiments of the invention. Similar to the pattern of FIG. 15B, the light pattern can include a central light region, but also some dark regions near ends of the luminaire. FIG. 16C is an illustrative radiation pattern for light emitted by the luminaire of FIG. 16A in accordance with some embodiments of the invention.

Figure 17A:
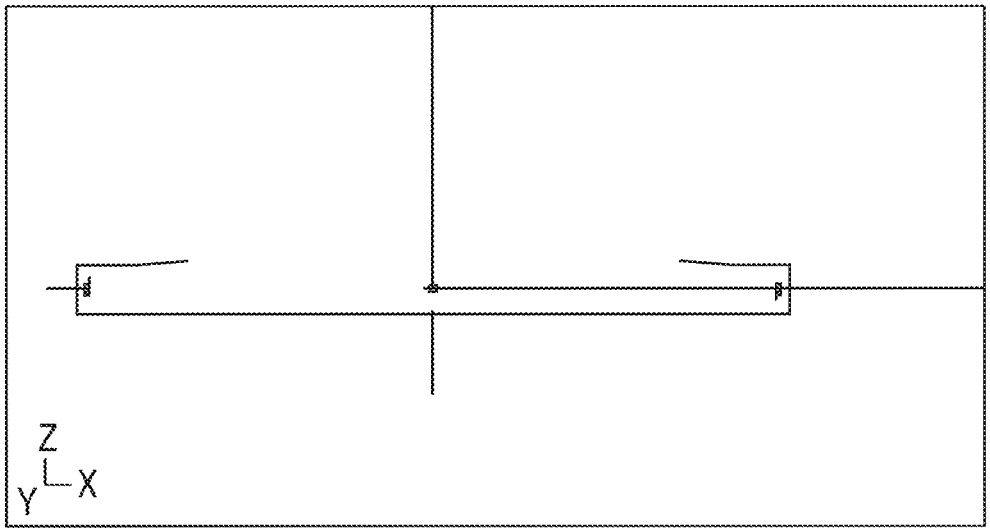
FIG. 17A shows a schematic side view of a portion of an illustrative luminaire in accordance with some embodiments of the invention.
Figure 17B:
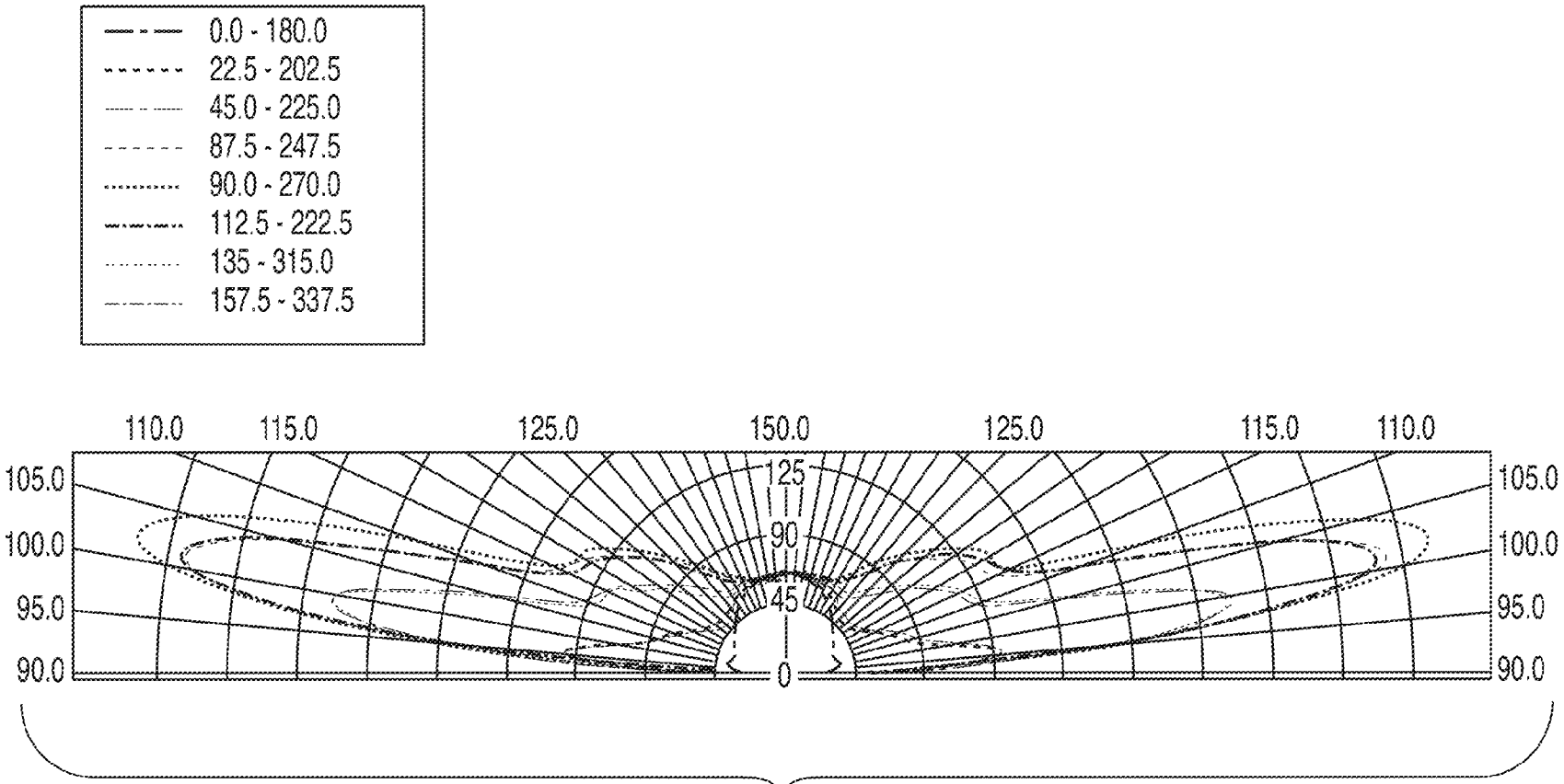
FIG. 17B is an illustrative radiation pattern for light emitted by the luminaire of FIG. 17A in accordance with some embodiments of the invention.

FIG. 17A shows a schematic side view of a portion of an illustrative luminaire in accordance with some embodiments of the invention. The luminaire can include no lens and an upward angled extension extending over edge lighting LED modules (e.g., angled away from a frame of the luminaire). In some cases, the extension can be opaque to control an angle at which light is emitted. FIG. 17B is an illustrative radiation pattern for light emitted by the luminaire of FIG. 17A in accordance with some embodiments of the invention. The radiation pattern shown in FIG. 17B can include dip near the centerline (e.g., corresponding to an angle of 90 degrees), indicating that although light may be provided away from the luminaire, there may be a darker region immediately above the luminaire.

Figure 18A:
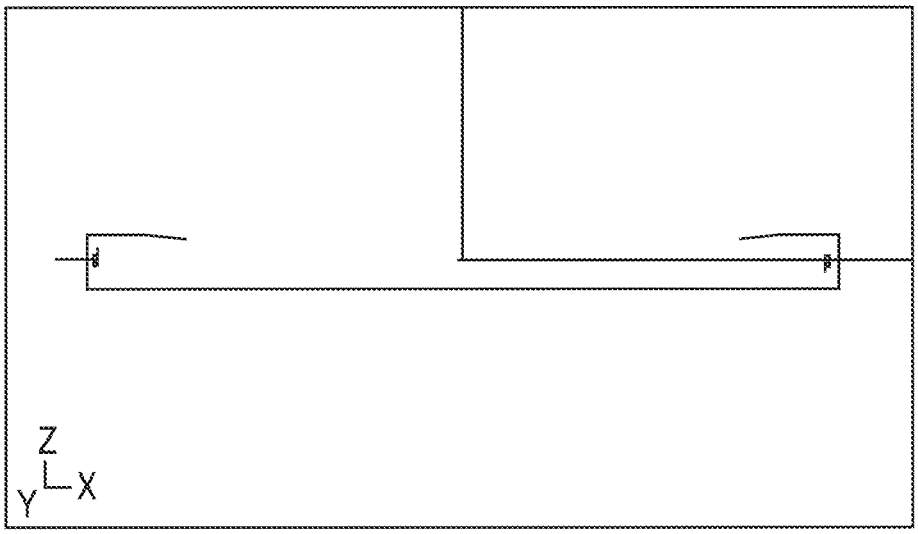
FIG. 18A shows a schematic side view of a portion of an illustrative luminaire in accordance with some embodiments of the invention.
Figure 18B:
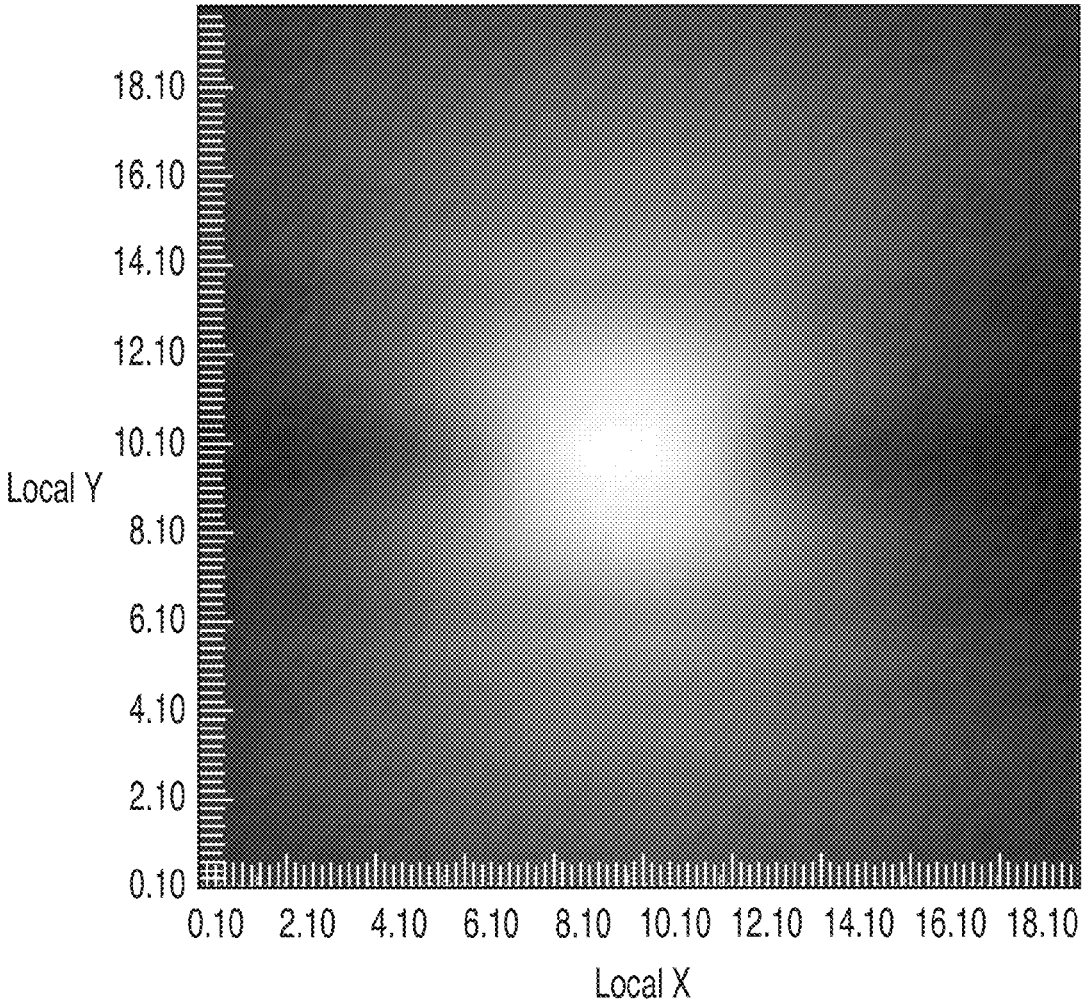
FIG. 18B is a schematic view of an illustrative illumination pattern on a ceiling above the luminaire of FIG. 18A in accordance with some embodiments of the invention.
Figure 18C:
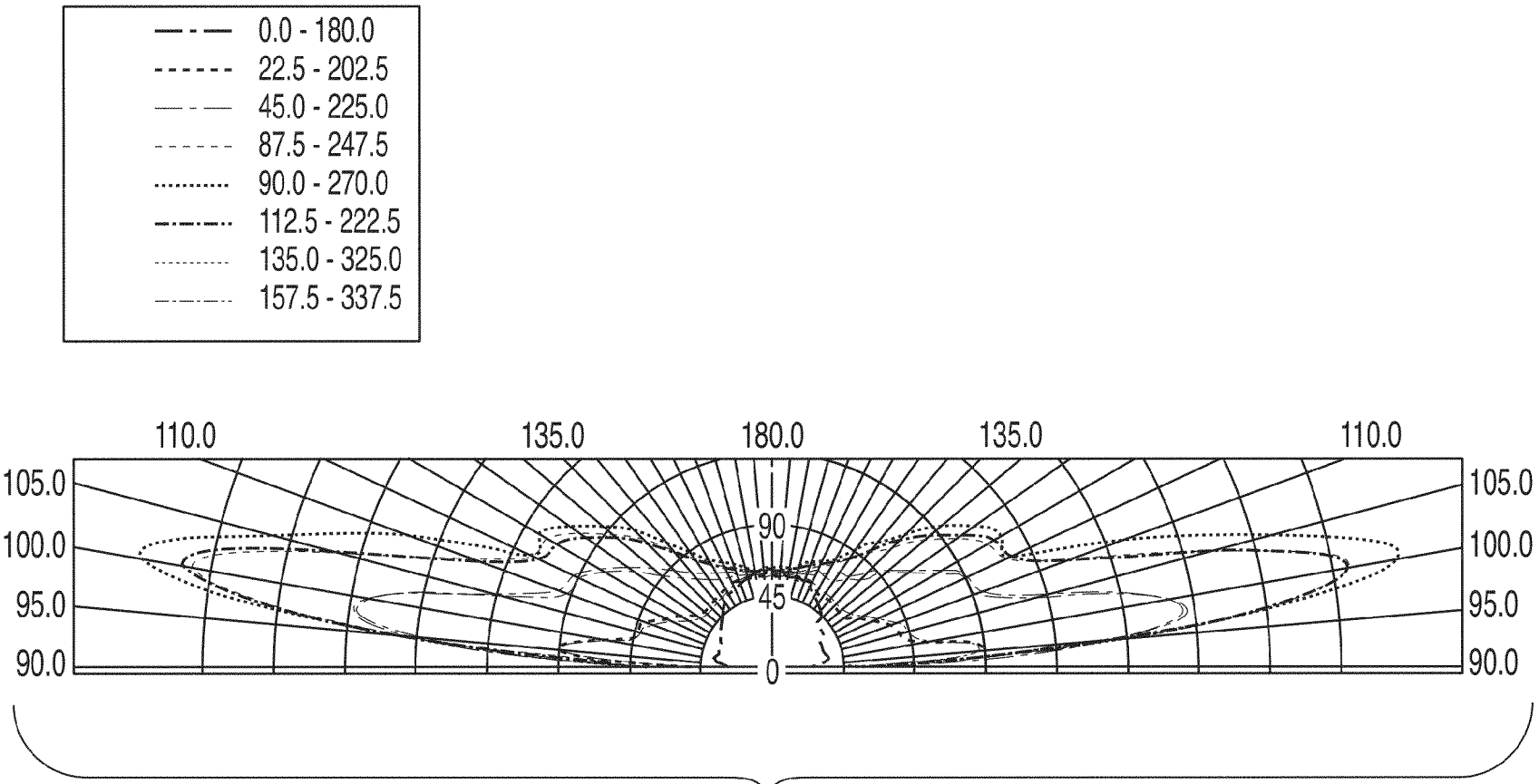
FIG. 18C is an illustrative radiation pattern for light emitted by the luminaire of FIG. 18A in accordance with some embodiments of the invention.

FIG. 18A shows a schematic side view of a portion of an illustrative luminaire in accordance with some embodiments of the invention. The luminaire can include no lens and a downward angled extension extending over edge lighting LED modules (e.g., angled towards a frame of the luminaire). In some cases, the extension can be opaque to control the angle at which light is emitted from the luminaire. FIG. 18B is a schematic view of an illustrative illumination pattern on a ceiling above the luminaire of FIG. 18A in accordance with some embodiments of the invention. FIG. 18C is an illustrative radiation pattern for light emitted by the luminaire of FIG. 18A in accordance with some embodiments of the invention. As can be seen by the radiation pattern of FIG. 18C, the luminaire of FIG. 18A can include dip near the centerline (e.g., corresponding to an angle of 90 degrees), indicating that although light may be provided away from the luminaire, there may be a darker region immediately above the luminaire (as shown in FIG. 18B).

Figure 19A:
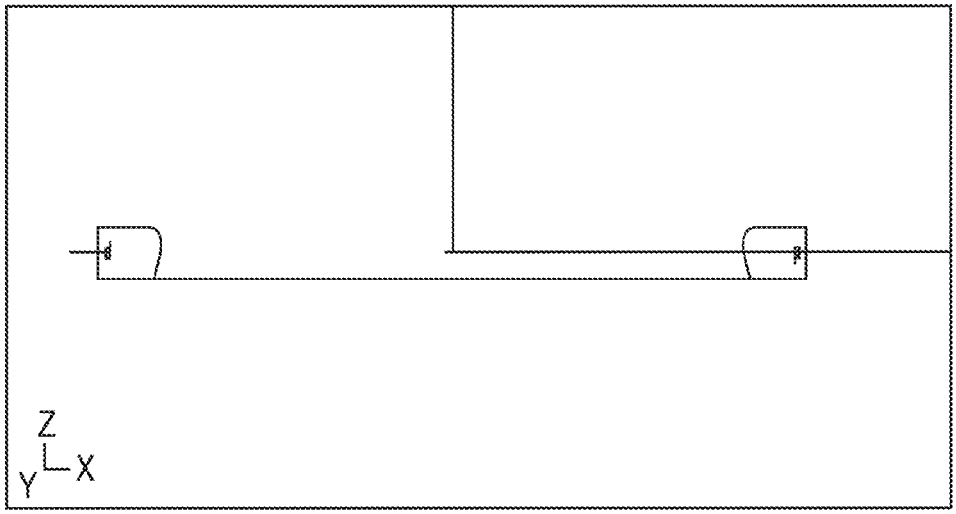
FIG. 19A shows a schematic side view of a portion of an illustrative luminaire in accordance with some embodiments of the invention.
Figure 19B:
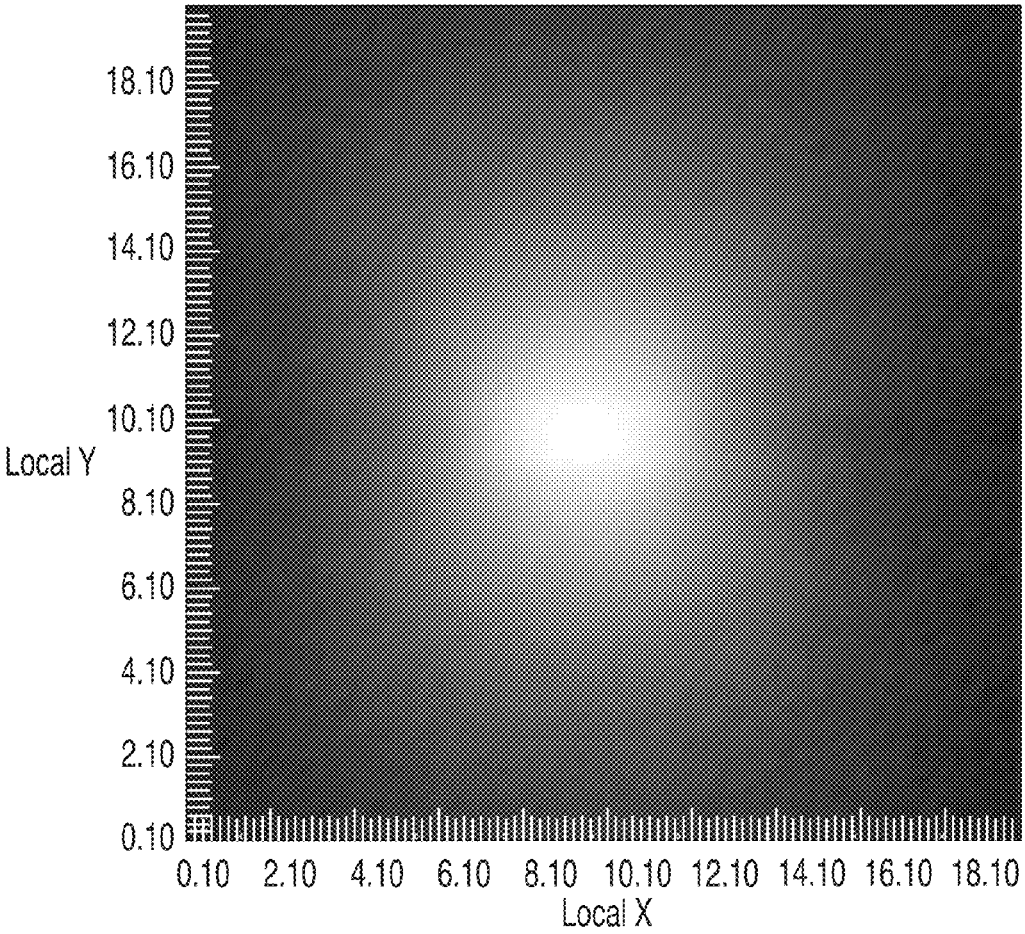
FIG. 19B is a schematic view of an illustrative illumination pattern on a ceiling above the luminaire of FIG. 19A in accordance with some embodiments of the invention.
Figure 19C:
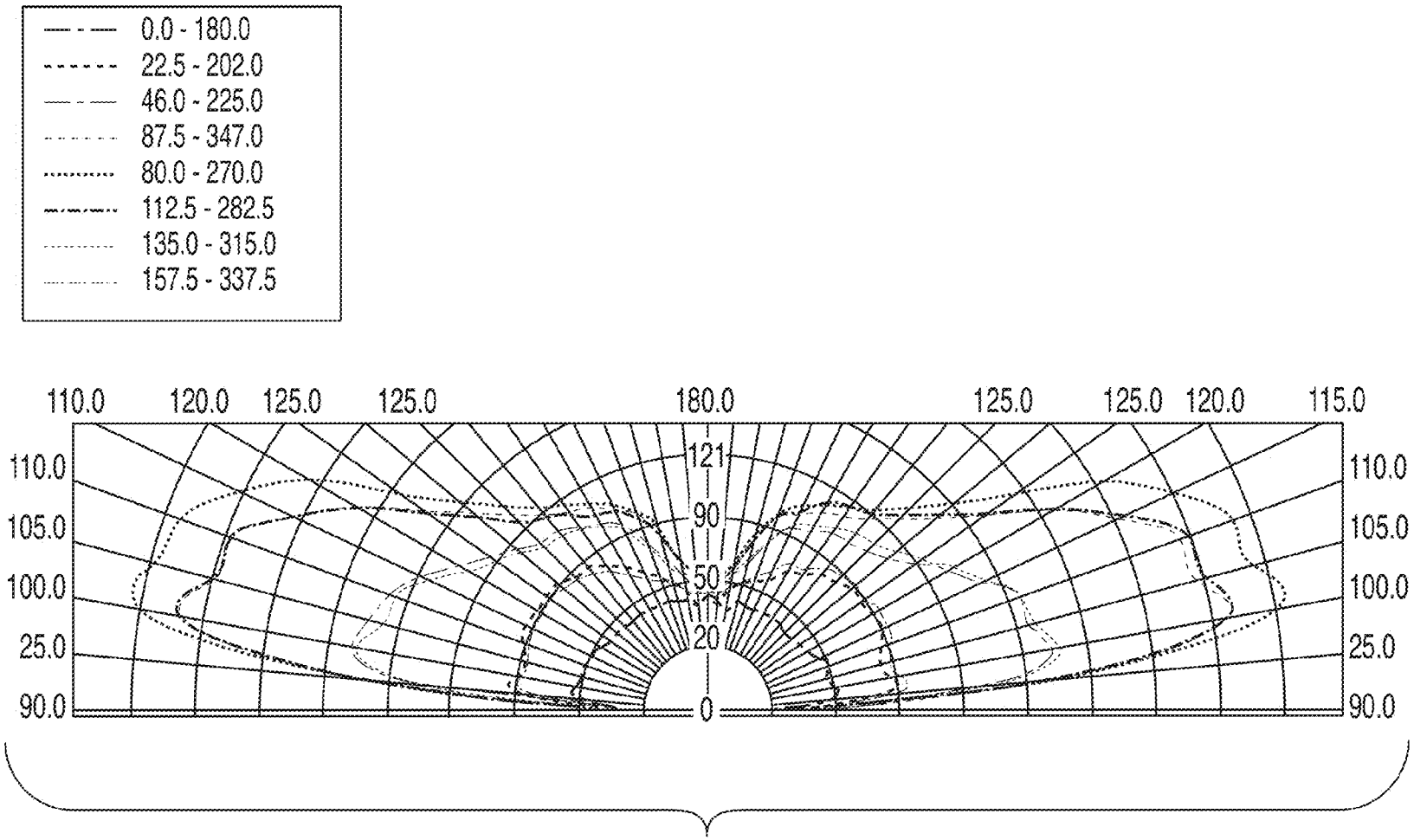
FIG. 19C is an illustrative radiation pattern for light emitted by the luminaire of FIG. 19A in accordance with some embodiments of the invention.

FIG. 19A shows a schematic side view of a portion of an illustrative luminaire in accordance with some embodiments of the invention. The luminaire can include a lens and no diffusive layer. FIG. 19B is a schematic view of an illustrative illumination pattern on a ceiling above the luminaire of FIG. 19A in accordance with some embodiments of the invention. FIG. 19C is an illustrative radiation pattern for light emitted by the luminaire of FIG. 19A in accordance with some embodiments of the invention. As can be seen by the radiation pattern of FIG. 19C, the luminaire of FIG. 19A can include wide lobes at wide angles and a larger dip near the centerline (e.g., corresponding to an angle of 90 degrees), indicating substantial amounts of light may be provided away from the luminaire at wide angles, though there may be a darker region immediately above the luminaire (as shown in FIG. 19B).

Figure 20:
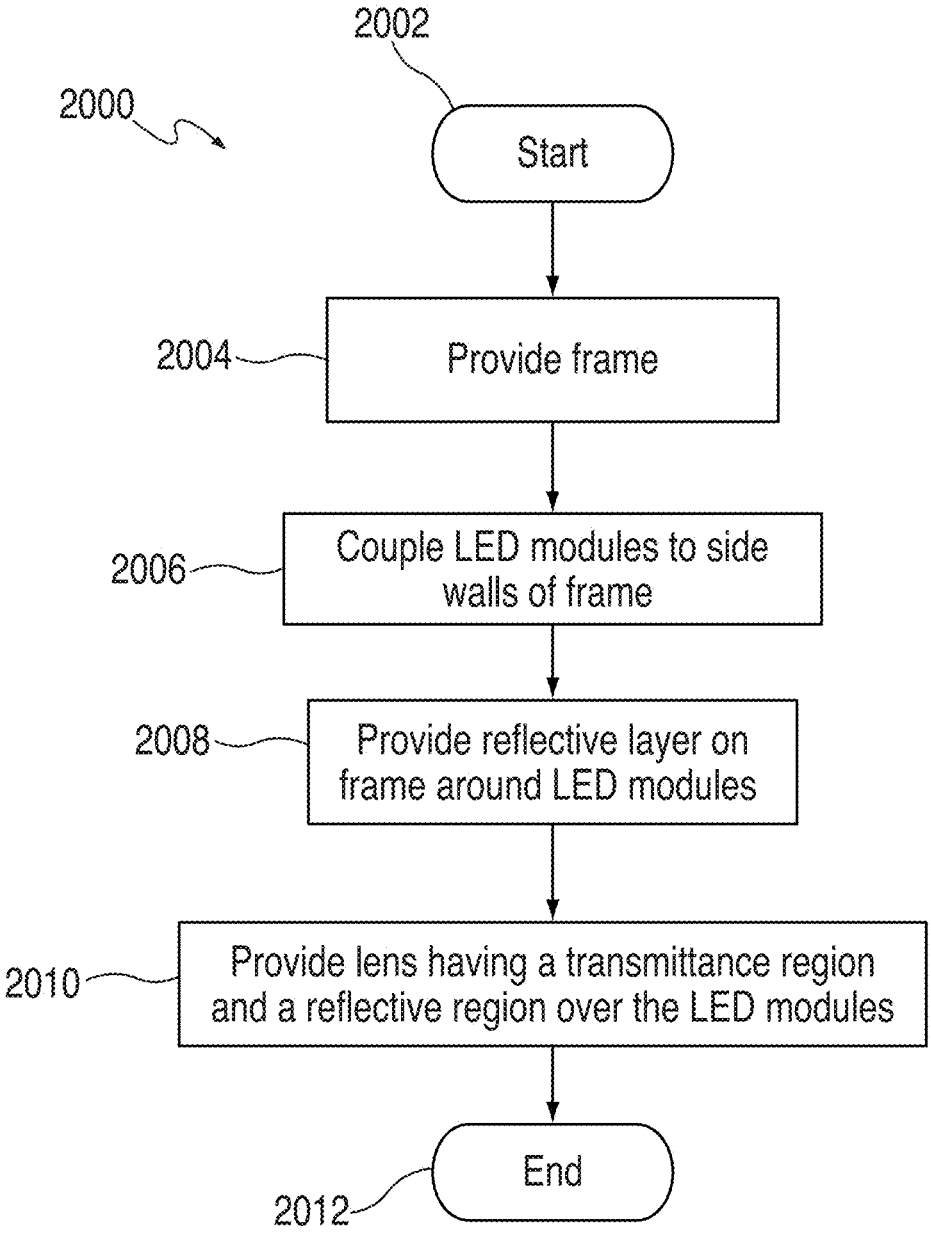
FIG. 20 is a flowchart of an illustrative process for defining a luminaire having light wells in accordance with some embodiments of the invention.

FIG. 20 is a flowchart of an illustrative process for defining a luminaire having light wells in accordance with some embodiments of the invention. Process 2000 can begin at step 2002. At step 2004, a frame can be provided. The frame can include a center plate and side walls. In some cases, the frame can be elongated along an axis. At step 2006, LED modules can be coupled to side walls of the frame. In some cases, the LED modules can be disposed such that they provide light across the center plate towards each other. At step 2008, a reflective layer can be provided on the frame around the LED modules. For example, a reflective layer can be provided on the center plate and on portions of the side walls that do not support LED modules. At step 2010, lens having a transmittance region and a reflective region can be provided over the LED modules. The lens can be secured to the frame, for example by sliding the lens into a slot of the frame. The transmittance region can be disposed such that the lens encloses a volume around the lens in which all or most surfaces of the volume, except for the transmittance region, are reflective to direct light from the LED through the transmittance region. Process 2000 can then end at step 2012.

It is to be understood that the steps shown in process 2000 of FIG. 20 are merely illustrative and that existing steps may be modified or omitted, additional steps may be added, and the order of certain steps may be altered. Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The above-described embodiments of the invention are presented for purposes of illustration and not of limitation.

What is claimed is:

1. An LED luminaire, comprising:

a frame comprising an elongated center plate and first and second side walls extending from opposite long edges of the center plate;

a first LED module secured to the first side wall adjacent to an upper surface of the center plate;

a second LED module secured to the second side wall adjacent to an upper surface of the center plate, wherein the first and second LED modules are oriented to emit light substantially parallel to the center plate; and a first light well disposed over the first LED module and a second light well disposed over the second LED module, wherein the first and second light wells each comprise an internal volume in which light emitted by the first and second LED modules, respectively, is reflected internally until it is transmitted by a transmittance region of the first and second light wells, respectively, substantially at an angle in the range of 100 degrees to 120 degrees relative to a nadir of the luminaire.

2. The LED luminaire of claim 1, further comprising:

a reflective layer disposed on a surface of the center plate between the first and second light wells.

3. The LED luminaire of claim 2, wherein:

the reflective layer extends from the first side wall to the second side wall, wherein portions of the reflective layer are within each of the first light well and the second light well.

4. The LED luminaire of claim 1, wherein:

the first LED module is oriented to emit light towards the second LED module.

5. The LED luminaire of claim 1, wherein:

the first and second side walls are substantially perpendicular to the center plate.

6. The LED luminaire of claim 1, wherein the first light well further comprises:

a lens comprising a lens base and a lens region, wherein the lens region extends at an angle from the lens base, and wherein the lens region is transmissive and the lens base is reflective.

7. The LED luminaire of claim 6, wherein:

the lens base comprises a protrusion at a first end of the lens base, wherein the protrusion is operative to be received by the frame.

8. The LED luminaire of claim 7, wherein:

the lens base comprises an opaque extension, wherein the lens region extends from the lens base between the protrusion and the extension.

9. The LED luminaire of claim 1, wherein:

most light is transmitted by the first light well at an angle substantially equal to 105 degrees relative to the nadir of the luminaire.

10. A method for defining an LED luminaire having light wells, comprising:

providing a frame having a planar center plate and two side walls disposed perpendicular to the center plate and substantially parallel to one another;

coupling LED modules to each of the two side walls and adjacent to an upper surface of the frame, wherein the LED modules are oriented to illuminate each other;

providing a reflective layer on the center plate and on the two side walls, wherein the reflective layer surrounds the LED modules;

providing a lens having a transmittance regions and a reflective regions over the LED modules, wherein the lens enclose a volume around the LED modules such that the transmittance regions are disposed between the LED modules; and securing the lens to the frame, wherein a protrusion of the lens engages a slot of the frame.

11. The method of claim 10, wherein:

the reflective layer comprises a white diffuse layer.

12. The method of claim 10, wherein providing the reflective layer further comprises:

providing a first reflective layer on the center plate, wherein the reflective layer extends between the two side walls; and securing the first reflective layer by placing the lens over the first reflective layer.

13. The method of claim 10, wherein:

the reflective regions of the lens comprise an extension reflecting some light transmitted through the transmittance regions of the lens.

14. A light well for use in an LED luminaire, comprising:

a portion of a frame operative to receive an LED module;

a lens coupled to the frame to define a volume between the lens and the portion of the frame, the volume enclosing the LED module, wherein the lens comprises a transmittance region and a reflective region;

a plurality of reflective layers enclosed within the volume, the plurality of reflective layers covering the portion of the frame not receiving the LED module and the reflective region of the lens; the lens further comprises a protrusion operative to engage a slot in the portion of the frame.

15. The light well of claim 14, wherein:

the plurality of reflective layers comprise white diffusive layers.

16. The light well of claim 14, wherein:

the transmittance region is perpendicular to the reflective region.

17. The light well of claim 16, wherein:

the transmittance region extends from a portion of the reflective region that is between ends of the reflective region.

18. The light well of claim 14, wherein the transmittance region further comprises:

a smooth outer surface; and a rough inner surface, wherein the LED modules faces the inner surface.

* * * * *